US010186414B2

(12) United States Patent
Blondia

(10) Patent No.: US 10,186,414 B2
(45) Date of Patent: Jan. 22, 2019

(54) DUAL PARABOLIC LASER DRIVEN SEALED BEAM LAMPS

(71) Applicant: Excelitas Technologies Corp., Waltham, MA (US)

(72) Inventor: Rudi Blondia, Stockton, CA (US)

(73) Assignee: Excelitas Technologies Corp., Waltham, MA (US)

( * ) Notice: Subject to any disclaimer, the term of this patent is extended or adjusted under 35 U.S.C. 154(b) by 0 days.

(21) Appl. No.: 15/604,925

(22) Filed: May 25, 2017

(65) Prior Publication Data

US 2017/0263433 A1 Sep. 14, 2017

Related U.S. Application Data

(60) Division of application No. 14/938,353, filed on Nov. 11, 2015, now Pat. No. 9,741,553, which is a (Continued)

(51) Int. Cl.
*H01J 61/02* (2006.01)
*H01J 61/30* (2006.01)
(Continued)

(52) U.S. Cl.
CPC ..... *H01J 61/025* (2013.01); *H01J 61/16* (2013.01); *H01J 61/24* (2013.01); *H01J 61/30* (2013.01);
(Continued)

(58) Field of Classification Search
None
See application file for complete search history.

(56) References Cited

U.S. PATENT DOCUMENTS 3,502,929 A 3/1970 Richter
3,515,491 A 6/1970 Emary
(Continued)

FOREIGN PATENT DOCUMENTS

DE 10 2011 113681 3/2013
EP 1335640 8/2003
(Continued)

OTHER PUBLICATIONS

DS004 EQ-10M—Data Sheet, Energetiq, 2005.
(Continued)

*Primary Examiner* — Ashok Patel
(74) *Attorney, Agent, or Firm* — Peter A. Nieves; Sheehan Phinney Bass & Green PA

(57) ABSTRACT

The invention is directed to a sealed high intensity illumination device configured to receive a laser beam from a laser light source. A sealed chamber is configured to contain an ionizable medium. The chamber includes a reflective chamber interior surface having a first parabolic contour and parabolic focal region, a second parabolic contour and parabolic focal region, and an interface surface. An ingress surface is disposed within the interface surface configured to admit the laser beam into the chamber, and an egress surface disposed within the interface surface configured to emit high intensity light from the chamber. The first parabolic contour is configured to reflect light from the first parabolic focal region to the second parabolic contour, and the second parabolic contour is configured to reflect light from the first parabolic contour to the second parabolic focal region.

19 Claims, 21 Drawing Sheets

Related U.S. Application Data continuation-in-part of application No. 14/712,196, filed on May 14, 2015, now Pat. No. 9,748,086.

(60) Provisional application No. 61/993,735, filed on May 15, 2014.

(51) Int. Cl.

| | |
|---|---|
| ***H01J 61/33*** | (2006.01) |
| ***H01J 61/35*** | (2006.01) |
| ***H01J 65/04*** | (2006.01) |
| ***H01J 61/54*** | (2006.01) |
| ***H01J 61/16*** | (2006.01) |
| ***H01J 61/24*** | (2006.01) |
| ***F21V 7/00*** | (2006.01) |
| ***F21V 3/00*** | (2015.01) |

(52) U.S. Cl.

CPC ..... *H01J 61/33* (2013.01); *H01J 61/35* (2013.01); *H01J 61/54* (2013.01); *H01J 65/04* (2013.01); *H01J 65/042* (2013.01)

(56) References Cited

U.S. PATENT DOCUMENTS

| | | | |
|---|---|---|---|
| 3,619,588 | A | 11/1971 | Chambers |
| 3,826,996 | A | 7/1974 | Jaegle |
| 3,900,803 | A | 8/1975 | Silfvast et al. |
| 4,088,966 | A | 5/1978 | Semis |
| 4,152,625 | A | 5/1979 | Conrad |
| 4,420,690 | A | 12/1983 | Kuehl |
| 4,498,029 | A | 2/1985 | Yoshizawa |
| 4,622,464 | A | 11/1986 | Sukigara et al. |
| 4,646,215 | A | 2/1987 | Levin |
| RE32,626 | E | 3/1988 | Yoshizawa |
| 4,738,748 | A | 4/1988 | Kisa |
| 4,780,808 | A | 10/1988 | Cross et al. |
| 4,789,788 | A | 12/1988 | Cox |
| 4,866,517 | A | 9/1989 | Mochizuki et al. |
| 5,747,813 | A | 5/1998 | Norton et al. |
| 5,798,805 | A | 8/1998 | Ooi |
| 5,905,268 | A | 5/1999 | Garcia et al. |
| 5,940,182 | A | 8/1999 | Lepper, Jr. et al. |
| 6,184,517 | B1 | 2/2001 | Sawada |
| 6,285,743 | B1 | 9/2001 | Hiroyuki |
| 6,288,780 | B1 | 9/2001 | Fairiey et al. |
| 6,325,255 | B1 | 11/2001 | Hiroyuki |
| 6,414,436 | B1 | 7/2002 | Eastlund |
| 6,417,625 | B1 | 7/2002 | Brooks et al. |
| 6,541,924 | B1 | 4/2003 | Kane et al. |
| 6,679,276 | B1 | 1/2004 | Brown et al. |
| 6,737,809 | B2 | 5/2004 | Espiau et al. |
| 6,762,849 | B1 | 7/2004 | Ruikens |
| 6,788,404 | B2 | 9/2004 | Lange |
| 6,956,329 | B2 | 10/2005 | Brooks et al. |
| 6,960,872 | B2 | 11/2005 | Beeson |
| 6,972,421 | B2 | 12/2005 | Melnychuk |
| 7,050,149 | B2 | 5/2006 | Owa et al. |
| 7,294,839 | B2 | 11/2007 | Rich et al. |
| 7,295,739 | B2 | 11/2007 | Solarz |
| 7,307,375 | B2 | 12/2007 | Smith |
| 7,390,116 | B2 | 6/2008 | Jain |
| 7,427,167 | B2 | 9/2008 | Holder et al. |
| 7,429,818 | B2 | 9/2008 | Chang |
| 7,439,530 | B2 | 10/2008 | Ershov |
| 7,652,430 | B1 | 1/2010 | Delgado |
| 7,744,241 | B2 | 6/2010 | Xu |
| 8,192,053 | B2 | 6/2012 | Owen et al. |
| 8,242,571 | B2 | 8/2012 | Blondia |
| 8,242,671 | B2 | 8/2012 | Blondia et al. |
| 8,242,695 | B2 | 8/2012 | Sumitomo |
| 8,253,926 | B2 | 8/2012 | Sumitomo et al. |
| 8,288,947 | B2 | 10/2012 | Yokota et al. |
| 2001/0016430 | A1 | 8/2001 | Nakano |
| 2001/0035720 | A1 | 11/2001 | Guthrie et al. |
| 2002/0017399 | A1 | 2/2002 | Chang |
| 2002/0021508 | A1 | 2/2002 | Ishihara |
| 2002/0044629 | A1 | 4/2002 | Hertz |
| 2002/0080834 | A1 | 6/2002 | Kusunose |
| 2003/0052609 | A1 | 3/2003 | Eastlund |
| 2003/0068012 | A1 | 4/2003 | Ahmad |
| 2003/0147499 | A1 | 8/2003 | Kondo |
| 2003/0168982 | A1 | 9/2003 | Kim |
| 2003/0231496 | A1 | 12/2003 | Sato |
| 2004/0016894 | A1 | 1/2004 | Wester |
| 2004/0026512 | A1 | 2/2004 | Otsubo |
| 2004/0129896 | A1 | 7/2004 | Schmidt |
| 2004/0183031 | A1 | 9/2004 | Silverman et al. |
| 2004/0183038 | A1 | 9/2004 | Hiramoto et al. |
| 2004/0238762 | A1 | 12/2004 | Mizoguchi et al. |
| 2004/0264512 | A1 | 12/2004 | Hartlove et al. |
| 2005/0036314 | A1* | 2/2005 | Kobayashi ..... F21V 7/0016 362/257 |
| 2005/0167618 | A1 | 8/2005 | Hoshino et al. |
| 2005/0205811 | A1 | 9/2005 | Partlo et al. |
| 2005/0207454 | A1 | 9/2005 | Starodoumov et al. |
| 2005/0243390 | A1 | 11/2005 | Tejnil |
| 2006/0039435 | A1 | 2/2006 | Cheymol |
| 2006/0097203 | A1 | 5/2006 | Bykanov et al. |
| 2006/0109455 | A1 | 5/2006 | Haverlag |
| 2006/0131515 | A1 | 6/2006 | Partlo |
| 2006/0152128 | A1 | 7/2006 | Manning |
| 2006/0219957 | A1 | 10/2006 | Ershov |
| 2007/0115468 | A1 | 5/2007 | Barnard |
| 2007/0228288 | A1 | 10/2007 | Smith |
| 2007/0228300 | A1 | 10/2007 | Smith |
| 2007/0285921 | A1 | 12/2007 | Zulim et al. |
| 2008/0055712 | A1 | 3/2008 | Noelscher |
| 2008/0280079 | A1 | 11/2008 | Watanabe |
| 2009/0140651 | A1 | 6/2009 | Hori |
| 2010/0264820 | A1 | 10/2010 | Sumitomo |
| 2011/0204265 | A1 | 8/2011 | Smith |
| 2013/0329204 | A1 | 12/2013 | Pellemans et al. |
| 2015/0262808 | A1 | 9/2015 | Wang |

FOREIGN PATENT DOCUMENTS

| | | |
|---|---|---|
| JP | 08299951 | 11/1996 |
| WO | WO2007120521 | 10/2007 |
| WO | WO2010002766 | 1/2010 |
| WO | 2010093903 | 8/2010 |

OTHER PUBLICATIONS

John Powell and Claes Magnusson; Handbook of Laser Technologies and Applications Volume III Applications, Part D: 1.2, pp. 1587-1611; 2004, published by Institute of Physics Publishing.

Digonnet, Michel J.F., editor, Rare-Earth-Doped-Fiber Lasers and Amplifiers, Second Edition, Revised and Expanded Cremers, et al; Evaluation of the Continuous Optical Discharge for Spectrochemical Analysis; Spechtrochimica Acta, Part B. Atomic Spectroscopy; vol. 40B No. 4, 1985.

ASML's customer magazine, 2014; ASML Holding BV.

Raizer, Yuri P.; Gas Discharge Physics, Springer-Verlag 1991; pp. 35-51; 307-310.

Raizer, Yuri P.; Gas Discharge Physics, Springer-Verlag corrected and printing 1997; pp. 35-51; 307-310.

V.P. Zimakov, et al; Interaction of Near-IR Laser Radiation with Plasma of a Continuous Optical Discharge; Plasma Physics Reports 2016, vol. 42, No. 1, pp. 68-73.

Bezel, et al "High Power Laser-Sustained Plasma Light Sources for KLA-Tencor Broadband Inspection Tool"; Conference Paper • May 2015, KLATencor, Milpitas, California.

Energetiq Technology, Inc,; LDLS™ Laser-Driven Light Source EQ-1000 High Brightness DUV Light Source Data Sheet; 2008; Woburn, Massachusetts.

Rudoy, et al; Xenon Plasma Sustained by Pulse-Periodic Laser Radiation; Plasma Physics Reports, 2015, vol. 41, No. 10, pp. 858-861. Pleiades Publishing, Ltd., 2015.

Knecht, et al; Optical pumping of the XeF(C-+A) and iodine 1.315-pm lasers by a compact surface discharge system; Opt. Eng. 42(12) 3612-3621 (Dec. 2003).

(56) References Cited

OTHER PUBLICATIONS

Fridman, et al; Plasma Physics and Engineering: Published in 2004 by Taylor & Francis, pp. 404-419; 618-619.
Model EQ-99 LDLS™ Laser-Driven Light Source; Operation and Maintenance Manual Revision Mar. 2, 2012.
Martin van den Brink; Many ways to shrink: The right moves to 10 nanometer and beyond; Presentation at ASML SmallTalk 2014; London; Nov. 2014.
Laser Pumped Plasma Broadband Light Souce by RnD Isan (no date).
Toumanov; Plasma and High Frequency Processes for Obtaining and Processing Materials in The Nuclear Fuel Cycle; Nova Science Publishers, Inc., New York, 2003, p. 60.
Klauminzer; Cost Considerations for Industrial Excimer Lasers; Laser Focus, The Magazine of Electro-Optics Technology; Dec. 1985.
S. C. Tidwell, ; Highly efficient 60-W TEMoo cw diode-end-pumped Nd:YAG laser; Optics Letters / vol. 18, No. 2 / Jan. 15, 1993, pp. 116-118.
R. J. Shine; Jr; 40-W cw, TEM00-mode, diode-laser-pumped, Nd:YAG miniature-slab laser; Mar. 1 1995 / vol. 20, No. 5 / Optics Letters; pp. 459-461.
W. Schone, et at al; Diode-Pumped High-Power ow Nd:YAG Lasers; W. Waidelich, et al (eds.); Laser in Forschung and Technik; 1996.
Diogiovanni, et al; High Power Fiber Lasers and Amplifiers; Optics & Photonics News, Jan. 1999.
ASML YieldStar T-250D product sheet; ASML Product Catalog; Jan. 20, 2014.
ASML YieldStar S-250D product sheet; SML Product Catalog; Jan. 20, 2014.
Energetiq Technology Inc; Operation manual for LDLS™ Laser-Driven Light Source; Aug. 2009.
Bussiahn; Experimental and theoretical investigations of a low-pressure HE-Xe discharge for lighting purpose; Jounral of Applied Physics vol. 95, No. 9 May 1, 2004.
V.P. Zimakov, et al; Bistable behavior of a continuous optical discharge as a laser beam propagation effect; Laser Resonators, Microresonators, and Beam Control XV; vol. 8600, 860002 • © 2013 SPIE.
Fridman; et al; Plasma Physics: and Engineering, Second Edition; Published in 2011 by Taylor & Francis, pp. 409-424; 639-640.
Energetiq Technology, Inc.; Model EQ-1500, LDLS™ Laser-Driven Light Source, Operation Manual, May 2011.
Energetiq Technology, Inc.; Model EQ-77 L©LDLS™ Laser-Driven Light Source Operation Manual, Dec. 2015.
Energetiq Technology, Inc.; Model EQ-90-FC, LDLS™, Laser-Driven Light, Operation and Maintenance Manual, Jan. 2014.
Raizer, "Optical discharges," Soviet Physics Uspekhi 23(11) (1980).
Energetiq Technology, Inc.; Operation and Maintenance Manual, Model EQ-99X, LDLS Laser Driven, Light Source, Rev. 1 (Jan. 2014).
Lothar Klein; Measurements of Spectral Emission and Absorption of a High Pressure Xenon Arc in the Stationary and the Flashed Modes; Apr. 1968; vol. 7, No. 4, Applied Optics.
Energetiq Technology, Inc.; Operation and Maintenance Manual, Model EQ-99X-FC, LDLS Laser Driven Light Source, Rev. 1 (Jan. 2014).
Energetiq Technology, Inc.; Operation and Maintenance Manual, Model EQ-9-N, LDLS Laser-Driven Source, Rev. 6 (Sep. 2015).
Energetiq Technology, Inc.; A presentation titled "EQ-400 LDLS Laser-Driven Light Source," dated Feb. 2, 2015.
A presentation titled "Energetiq Laser-Driven Light Sources," dated Apr. 21, 2015.
Hailong Zhou, et al; Conductively cooled high-power, hight-brightness bars and fiber coupled arrays; High-Power Diode Laser Technology and Applications III, edited by Mark S. Zediker, Proc. of SPIE vol. 5711 (SPIE, Bellingham, WA, 2005).
Ytterbium-doped large-core fibre laser with 1 kW of continuous-wave output power; Y. Jeong, et al; Electronics Letters Apr. 15, 2004 vol. 40 No. 8.
A presentation titled "LDLS Laser-Driven Light Source," dated Jul. 8, 2011.
Castellano, "Are the Brains at ASML Hurting Investors With High and Ambitious R&D Costs?" Jul. 20, 2015.
M. W. P. Cann, Light Sources in the 0.15-20-μ Spectral Range, vol. 8 No. 8 Applied Optics (1969).
Kuhn, Kelin; Laser Engineeringl Prentice-hall Inc, 1998; pp. 384-440.
Moulton, Peter F.; Tunable Solid-State Lasers; Proceedings of the IEEE, vol. 80, No. 3, Mar. 1992.
Koch, K.K.; Sodium Plasma Produced by Milliwatt cw Laser Irradiation; Journal of the Optical Society of America; vol. 70, No. 6; Jun. 1980.
E. B. Saloman; Energy Levels and Observed Spectral Lines of Xenon, Xel through XeLIV; J. Phys. Chem. Ref. Data, vol. 33, No. 3, 2004.
International Search Report for PCT Application No. PCT/US2015/030740 dated Oct. 20, 2015.
Partial International Search Report for PCT Application No. PCT/US2015/030740, dated Aug. 11, 2015, 2 pages.
Excelitas Technologies; Cermax® Xenon Lamp Engineering Guide, Copyright 2011, www.excellitas.com.
Partial Search Report for PCT/US2016/031983 dated Aug. 16, 2016.
International Search Report for PCT/US16/32022, dated Jun. 24, 2016.
H.M. Pask, et al; Ytterbium-Doped Silica Fiber Lasers: Versatile Sources for the 1-1.2 um Region; IEEE Journal of Selected Topics in Quantum Electronics vol. 1, No. 1; Apr. 1993.
Chrisitan Stewen; A 1-kW CW Thin Disc Laser; IEEE Journal of Selected Topics in Quantum Electronics, vol. 6, No. 4, Jul./Aug. 2000.
Hecht, Eugene; Optics, 4ed; Pearson Addison Wesley; 2002; pp. 149-171, 243-273, 385-442.
KLA-Tencor; High Power Laser-Sustained Plasma Light Sources for KLA-Tencor Broadban Inspection Tools; Conference Paper • May 2015.
Davis, Christopher C.; Lasers and Electro-Optics; Fundamentals and Engineering; 1996, Cambridge University Press, pp. 14-35.
Tam, Quasiresonant laser-produced plasma: an efficient mechanism for localized breakdown; J. Appl. Phys. 51(9), Sep. 1980, p. 4682.
Measures, et al; Laser Interaction based on resonance saturation (LIBORS): an alternative to inverse bremsstrahlung for coupling laser energy into a plasma: Applied Optics, vol. 18, No. 11, Jun. 1, 1979.
Eletskii et al; Formation kinetics and parameters of a photoresonant plasma; Sov. Phys. JETP 67 (5); May 1988.
Ballman, et al; Synthetic Quartz with High Ultraviolet Transmission; Applied Optics; Jul. 1968, vol. 7, No. 7.
Energetiq Technology, Inc; LDLS™ Laser-Driven Light Source Data Sheet; 2008.
Patel and Zaidi, The suitability of sapphire for laser windows, MEas. Sci. Technol. 10 (1999).
Waynant, et al; Electro-Optics Handbook, Second Edition; Chapter 10; published by McGraw-Hill, 2000.
Excelitas Technologies Corp.; Cermax® Xenon Lamp Engineering Guide, 2011.
Perkinelmer Optoelectronics; Cermax® Xenon Lamp Engineering Guide, 1998.
G C Wei; Transparent ceramic lamp envelope materials; J. Phys. D: Appl. Phys. 38 (2005) 3057-3065.
PASCO Scientific; Instruction Sheet for the PASCO Model OS-9286A Mercury Vapor Light Source; 1990.
Generalov et al; "Continuous Optical Discharge," ZhETF Pis. Red. 11, No. 9, May 5, 1970, pp. 302-304.
Kozlov et al, "Radiative Losses by Argon Plasma and the Emissive Model of a Continuous Optical Discharge"; Sov. Phys.JETP, vol. 39, No. 3, Sep. 1974, pp. 463-468.
Wilbers et al, "The Continuum Emission of an Arc Plasma," J. Quant. Spectrosc. Radiat. Transfer, vol. 45, No. 1, 1991, pp. 1-10.

(56) References Cited

OTHER PUBLICATIONS

Wilbers, et al "The VUV Emissitvity of a High-Pressure Cascade Argon Arc from 125 to 200 nm," J.Quant. Spectrosc. Radiat. Transfer, vol. 46, 1991, pp. 299-308.
Luxtell LLC CeraLux Xenon Lamps Product Data Sheet; 2003-2004.
Laufer, Gabriel; Introduction to Optics and Lasers in Engineering; pp. 449-454, Cambridge University Press, 1996.
Yu, et al; LED-Based Projection Systems; Journal of Display Technology, vol. 3, No. 3, Sep. 2007.
Derra et al; UHP lamp systems for projection applications; J. Phys. D: Appl. Phys. 38 (2005) 2995-3010.
Ingle, James D., et al; Spectrochemical Analysis; 1988, Prentice-Hail Inc.; p. 59.
M.J. Soileau et al., Laser-Induced Damage Measurements in CdTe and Other II-VI Materials, Applied Optics, vol. 21, No. 22, pp. 4059-4062.
Roy Henderson et al., Laser Safety, pp. 435-443 (2004).
Turan Erdogan, Ph.D., CTO Semrock, Inc., A Unit of IDEX Corp; letter dated Feb. 28 2011 regarding Energetiq Technology's EQ-99 system.
Winners of 2010 Prism Awards Announced, Jan. 27, 2011; webpage from photonics.com.
http://mvw.rdmag,cornlaward-winners/2011/08/light-source-lifetime-lifted-laser-tech; The EQ-99 LDLS Laser-Driven Light Source, produced by Energetiq Technology Inc. 2011.
Energetiq Technology Inc. Press Release: Energetiq Announces Ultra-Compact Light Source for Next Generation HPLC and Advanced Microscopy; Jan. 21, 2010.
KLA-Tencor Launches 2830 and Puma 9500, eDR-5210 | Product Releases | Press Releases; Jul. 13, 2009.
Bussiahn, R. et al, "Experimental and theoretical investigations of a low-pressure He-Xe discharge for lighting purpose" Journal of Applied Physics, vol. 95, No. 9. May 1, 2004, pp. 4627-4634.
Beck, Simple Pulse Generator for Pulsing Xenon Arcs with High Repetition Rate, Rev. Sci. Instrum., vol. 45, No. 2, Feb. 1974, pp. 318-319.
Carlhoff, et al, "Continuous Optical Discharges at Very High Pressure," Physica 103C, pp. 439-447.
Fiedorowicz et al, X-Ray Emission from Laser-Irradiated Gas Puff Targets, Appl. Phys. Lett. 62(22). May 31, 1993.
Franzen, "CW Gas Breakdown in Argon Using 10.6-um Laser Radiation," Appl. Phys. Lett. vol. 21, No. 2 Jul. 15, 1972 pp. 62-64.
Jeng et al, Theoretical Investigation of Laser-sustained Argon Plasmas J.Appl.Phys. 60 (7), Oct. 1, 1986 pp. 2272-2279.
Nakar, "Radiometric Characterization of Ultrahigh Radiance Xenon Short-arc Discharge Lamps" Applied Optics, vol. 47 No. 2, Jan. 9, 2008, pp. 224-229.
Moody, "Maintenance of a Gas Breakdown in Argon Using 10.6-u cw Radiation," Journal of Applied Physics, vol. 46 No. 6, Jun. 1975, pp. 2475-2482.
Keefer, et al "Experimental Study of a Stationary Lesser-Sustained Air Plasma", Journal of Applied Physics, vol. 46., No. 3, Mar. 1975, pp. 1080-1083.
Nanometrics, Organic Growth Opportunities for Nanometrics in Process Control, Jan. 2016.
M.J. Soileau et al., Laser-Induced Damage Measurements in CdTe and Other II-VI Materials, Applied Optics, vol. 21. No. 22, pp. 4059-4062, Nov. 15, 1982.

* cited by examiner

FIG. 1
(PRIOR ART)
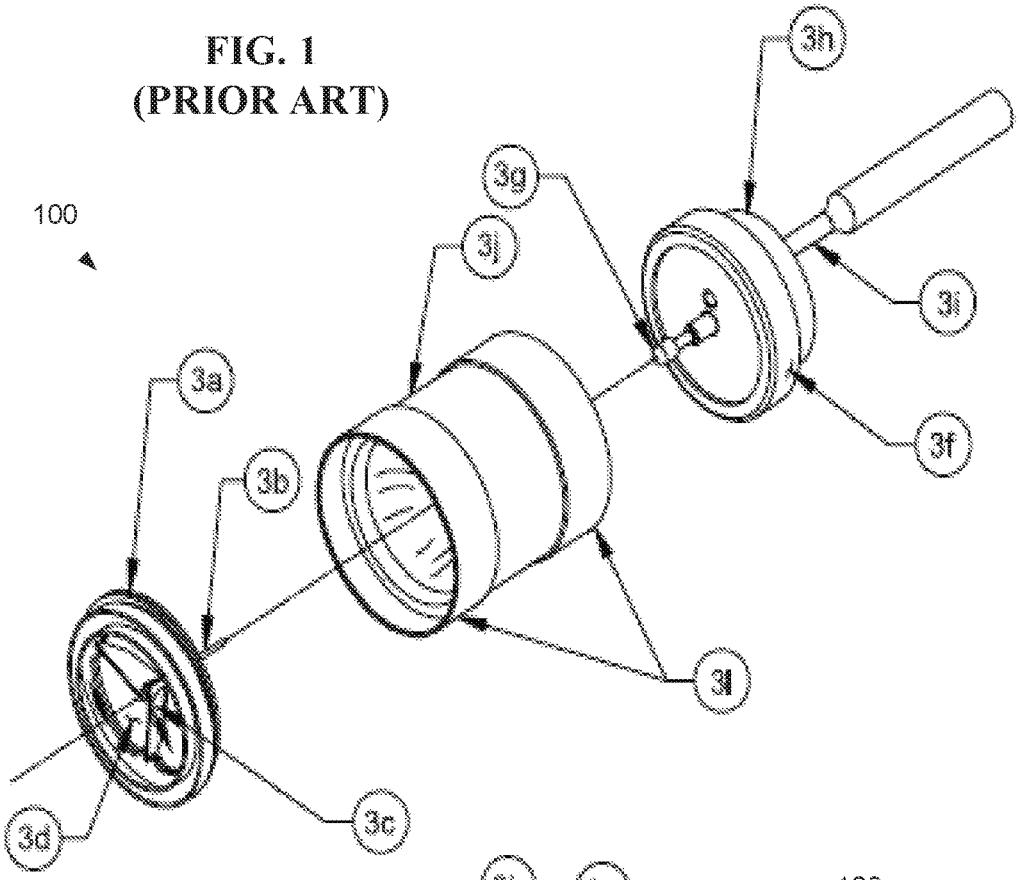
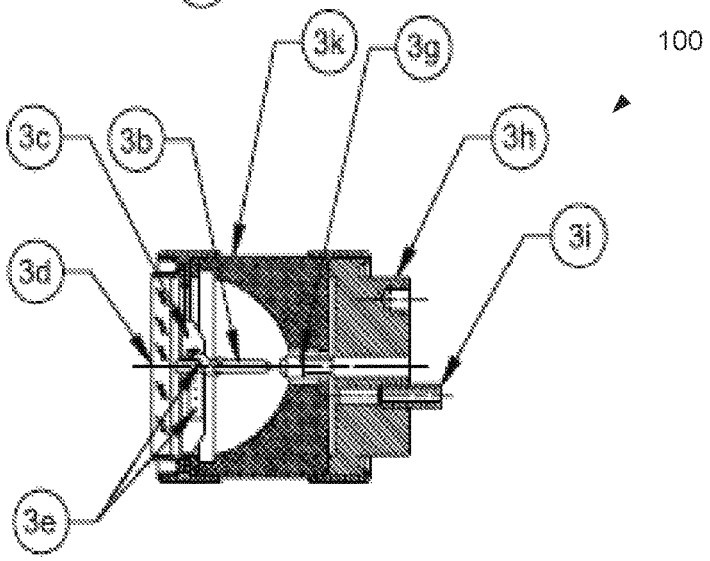
FIG. 2
(PRIOR ART)

DUAL PARABOLIC LASER DRIVEN SEALED BEAM LAMPS

CROSS-REFERENCE TO RELATED APPLICATIONS

This application is a divisional and claims the benefit of U.S. patent application Ser. No. 14/938,353, filed Nov. 11, 2015, entitled "Elliptical and Dual Parabolic Laser Driven Sealed Beam Lamps," which is a continuation in part of and claims the benefit of U.S. patent application Ser. No. 14/712,196, filed May 14, 2015, entitled "Laser Driven Sealed Beam Lamp," which in turn claims the benefit of U.S. Provisional Patent Application Ser. No. 61/993,735, filed May 15, 2014, entitled "Laser Driven Sealed Beam Xenon Lamp," each of which is hereby incorporated by reference herein in its entirety.

FIELD OF THE INVENTION

The present invention relates to illumination devices, and more particularly, is related to high-intensity arc lamps.

BACKGROUND OF THE INVENTION

High intensity arc lamps are devices that emit a high intensity beam. The lamps generally include a gas containing chamber, for example, a glass bulb, with an anode and cathode that are used to excite the gas (ionizable medium) within the chamber. An electrical discharge is generated between the anode and cathode to provide power to the excited (e.g. ionized) gas to sustain the light emitted by the ionized gas during operation of the light source.

FIG. 1 shows a pictorial view and a cross section of a low-wattage parabolic prior art Xenon lamp 100. The lamp is generally constructed of metal and ceramic. The fill gas, Xenon, is inert and nontoxic. The lamp subassemblies may be constructed with high-temperature brazes in fixtures that constrain the assemblies to tight dimensional tolerances. FIG. 2 shows some of these lamp subassemblies and fixtures after brazing.

There are three main subassemblies in the prior art lamp 100: cathode; anode; and reflector. A cathode assembly 3*a* contains a lamp cathode 3*b*, a plurality of struts holding the cathode 3*b* to a window flange 3*c*, a window 3*d*, and getters 3*e*. The lamp cathode 3*b* is a small, pencil-shaped part made, for example, from thoriated tungsten. During operation, the cathode 3*b* emits electrons that migrate across a lamp arc gap and strike an anode 3*g*. The electrons are emitted terminologically from the cathode 3*b*, so the cathode tip must maintain a high temperature and low-electron-emission to function.

The cathode struts 3*c* hold the cathode 3*b* rigidly in place and conduct current to the cathode 3*b*. The lamp window 3*d* may be ground and polished single-crystal sapphire (AlO2). Sapphire allows thermal expansion of the window 3*d* to match the flange thermal expansion of the flange 3*c* so that a hermetic seal is maintained over a wide operating temperature range. The thermal conductivity of sapphire transports heat to the flange 3*c* of the lamp and distributes the heat evenly to avoid cracking the window 3*d*. The getters 3*e* are wrapped around the cathode 3*b* and placed on the struts. The getters 3*e* absorb contaminant gases that evolve in the lamp during operation and extend lamp life by preventing the contaminants from poisoning the cathode 3*b* and transporting unwanted materials onto a reflector 3*k* and window 3*d*. The anode assembly 3*f* is composed of the anode 3*g*, a base 3*h*, and tabulation 3*i*. The anode 3*g* is generally constructed from pure tungsten and is much blunter in shape than the cathode 3*b*. This shape is mostly the result of the discharge physics that causes the arc to spread at its positive electrical attachment point. The arc is typically somewhat conical in shape, with the point of the cone touching the cathode 3*b* and the base of the cone resting on the anode 3*g*. The anode 3*g* is larger than the cathode 3*b*, to conduct more heat. About 80% of the conducted waste heat in the lamp is conducted out through the anode 3*g*, and 20% is conducted through the cathode 3*b*. The anode is generally configured to have a lower thermal resistance path to the lamp heat sinks, so the lamp base 3*h* is relatively massive. The base 3*h* is constructed of iron or other thermally conductive material to conduct heat loads from the lamp anode 3*g*. The tabulation 3*i* is the port for evacuating the lamp 100 and filling it with Xenon gas. After filling, the tabulation 3*i* is sealed, for example, pinched or cold-welded with a hydraulic tool, so the lamp 100 is simultaneously sealed and cut off from a filling and processing station. The reflector assembly 3*j* consists of the reflector 3*k* and two sleeves 3*l*. The reflector 3*k* may be a nearly pure polycrystalline alumina body that is glazed with a high temperature material to give the reflector a specular surface. The reflector 3*k* is then sealed to its sleeves 3*l* and a reflective coating is applied to the glazed inner surface.

During operation, the anode and cathode become very hot due to electrical discharge delivered to the ionized gas located between the anode and cathode. For example, ignited Xenon plasma may burn at or above 15,000 C, and a tungsten anode/cathode may melt at or above 3600 C. Degrees. The anode and/or cathode may wear and emit particles. Such particles can impair the operation of the lamp, and cause degradation of the anode and/or cathode.

One prior art sealed lamp is known as a bubble lamp, which is a glass lamp with two arms on it. The lamp has a glass bubble with a curved surface, which retains the ionizable medium. An external laser projects a beam into the lamp, focused between two electrodes. The ionizable medium is ignited, for example, using an ultraviolet ignition source, a capacitive ignition source, an inductive ignition source, a flash lamp, or a pulsed lamp. After ignition the laser generates plasma, and sustains the heat/energy level of the plasma. Unfortunately, the curved lamp surface distorts the beam of the laser. A distortion of the beam results in a focal area that is not crisply defined. While this distortion may be partially corrected by inserting optics between the laser and the curved surface of the lamp, such optics increase cost and complexity of the lamp, and still do not result in a precisely focused beam.

Compared with refectories small dimension concave and convex surfaces, lenses can be made more accurate and precise in their properties, as lenses can be ground and polished to much higher precision than a chamber interior reflective surface. On the other hand, mirrored surfaces may be more economical to produce in large assemblies where the surface defects are small in comparison to the aperture of the optics or the wavelengths under consideration.

When igniting laser plasma at low laser power, it is desirable that the focal spot of the laser is as small as possible and the numerical aperture (NA) is a large as possible. For example, such benefits are challenging when using the lamp 1600 of FIG. 16A. The parabolic mirror 1624 forming the interior surface of the lamp chamber 1620 is utilized to focus the laser light 1662 passing through the folding mirror 1680 and either high power or ignition aids are needed to ignite the laser plasma located at the focal region 1621. Practical implementations of parabolic mirrors suffer either from distortion from the optimal shape to surface roughness affecting the waist size of the laser beam 1662 size and shape. The folding mirror 1680 reflects the high intensity egress light 1629 toward a desired target, or toward intermediate optics (not shown).

Another implementation shown in FIG. 16B with a parabolic mirror adds a lens 1670 to focus the laser beam 1662 directly to the focal region 1621, allowing for a smaller plasma region. However, this lamp suffers from the low NA of the laser source, as the focal length of the lens needed in this implementation is fairly long. Therefore, there is a need to address one or more of the above mentioned shortcomings.

SUMMARY OF THE INVENTION

Embodiments of the present invention provide a laser driven sealed beam lamp. Briefly described, the present invention is directed to a sealed high intensity illumination device configured to receive a laser beam from a laser light source. A sealed chamber is configured to contain an ionizable medium. The chamber includes a reflective chamber interior surface having a first parabolic contour and first parabolic focal region, a second parabolic contour and second parabolic focal region, and an interface surface. An ingress surface is disposed within the interface surface is configured to admit the laser beam into the chamber, and an egress surface disposed within the interface surface is configured to emit high intensity light from the chamber. The first parabolic contour is configured to reflect light from the first parabolic focal region to the second parabolic contour, and the second parabolic contour is configured to reflect light from the first parabolic contour to the second parabolic focal region.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

FIG. 1 is a schematic diagram of a prior art high intensity lamp in exploded view.

FIG. 2 is a schematic diagram of a prior art high intensity lamp in cross-section view.

DETAILED DESCRIPTION

Figure 3A:
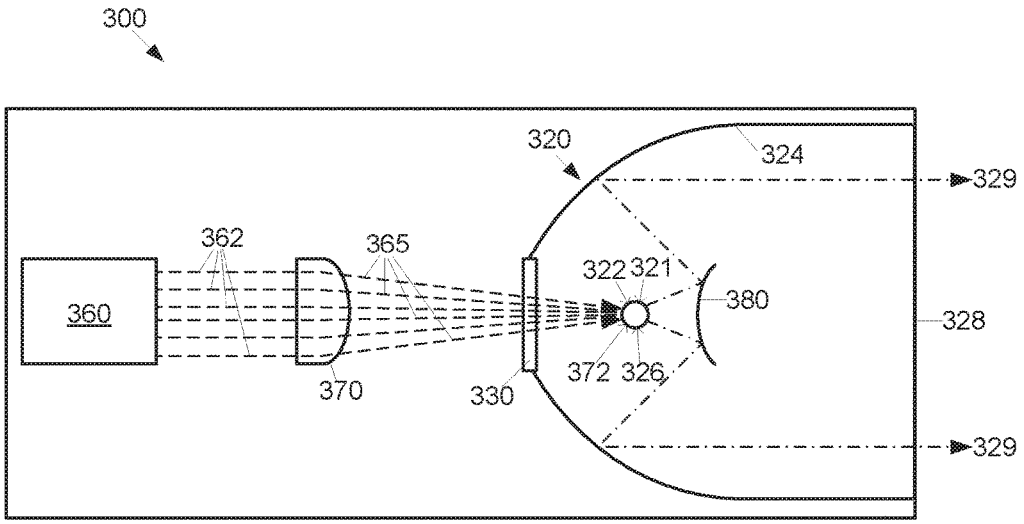
FIG. 3A is a schematic diagram of a first exemplary embodiment of a laser driven sealed beam lamp.

The following definitions are useful for interpreting terms applied to features of the embodiments disclosed herein, and are meant only to define elements within the disclosure.

As used within this disclosure, collimated light is light whose rays are parallel, and therefore will spread minimally as it propagates.

As used within this disclosure, a lens refers to an optical element that redirects/reshapes light passing through the optical element. In contrast, a mirror or reflector redirects/reshapes light reflected from the mirror or reflector.

As used within this disclosure, a direct path refers to a path of a light beam or portion of a light beam that is not reflected, for example, by a mirror. A light beam passing through a lens or a flat window is considered to be direct.

As used within this disclosure, "substantially" means "very nearly," or within normal manufacturing tolerances. For example, a substantially flat window, while intended to be flat by design, may vary from being entirely flat based on variances due to manufacturing.

Reference will now be made in detail to embodiments of the present invention, examples of which are illustrated in the accompanying drawings. Wherever possible, the same reference numbers are used in the drawings and the description to refer to the same or like parts.

FIG. 3A shows a first exemplary embodiment of a laser driven sealed beam lamp 300. The lamp 300 includes a sealed chamber 320 configured to contain an ionizable medium, for example, but not limited to, Xenon, Argon, or Krypton gas. The chamber 320 is generally pressurized, for example to a pressure level in the range of 20-60 bars. In contrast, Xenon "bubble" lamps are typically at 20 bars. At higher pressures the plasma spot may be smaller, which may be advantageous for coupling into small apertures, for example, a fiber aperture. The chamber 320 has an egress window 328 for emitting high intensity egress light 329. The egress window 328 may be formed of a suitable transparent material, for example quartz glass or sapphire, and may be coated with a reflective material to reflect specific wavelengths. The reflective coating may block the laser beam wavelengths from exiting the lamp 300, and/or prevent UV energy from exiting the lamp 300. The reflective coating may be configured to pass wavelengths in a certain range such as visible light.

The egress window 328 may also have an anti-reflective coated to increase the transmission of rays of the intended wavelengths. This may be a partial reflection or spectral reflection, for example to filter unwanted wavelengths from egress light 329 emitted by the lamp 300. An egress window 328 coating that reflects the wavelength of the ingress laser light 365 back into the chamber 320 may lower the amount of energy needed to maintain plasma within the chamber 320.

The chamber 320 may have a body formed of metal, sapphire or glass, for example, quartz glass. The chamber 320 has an integral reflective chamber interior surface 324 configured to reflect high intensity light toward the egress window 328. The interior surface 324 may be formed according to a shape appropriate to maximizing the amount of high intensity light reflected toward the egress window 328, for example, a parabolic or elliptical shape, among other possible shapes. In general, the interior surface 324 has a focal point 322, where high intensity light is located for the interior surface 324 to reflect an appropriate amount of high intensity light.

The high intensity egress light 329 output by the lamp 300 is emitted by a plasma formed of the ignited and energized ionizable medium within the chamber 320. The ionizable medium is ignited within the chamber 320 by one of several means, as described further below, at a plasma ignition region 321 within the chamber 320. For example, the plasma ignition region 321 may be located between a pair of ignition electrodes (not shown) within the chamber 320. The plasma is continuously generated and sustained at a plasma generating and/or sustaining region 326 within the chamber 320 by energy provided by ingress laser light 365 produced by a laser light source 360 located within the lamp 300 and external to the chamber 320. In the first embodiment, the plasma sustaining region 326 and the plasma ignition region 321 are co-located with a focal point 322 of the interior surface 324 at a fixed location. In alternative embodiments the laser light source 360 may be external to the lamp 300.

The chamber 320 has a substantially flat ingress window 330 disposed within a wall of the interior surface 324. The substantially flat ingress window 330 conveys the ingress laser light 365 into the chamber 320 with minimal distortion or loss, particularly in comparison with light conveyance through a curved chamber surface. The ingress window 330 may be formed of a suitable transparent material, for example quartz glass or sapphire.

A lens 370 is disposed in the path between the laser light source 360 and the ingress window 330 configured to focus the ingress laser light 365 to a lens focal region 372 within the chamber. For example, the lens 370 may be configured to direct collimated laser light 362 emitted by the laser light source 360 to the lens focal region 372. Alternatively, the laser light source 360 may provide focused light, and transmit focused ingress laser light 365 directly into the chamber 320 through the ingress window 330 without a lens 370 between the laser light source 360 and the ingress window 330, for example using optics within the laser light source 360 to focus the ingress laser light 365. In the first embodiment, the lens focal region 372 is co-located with the plasma sustaining region 326, the plasma ignition region 321, and the focal point 322 of the interior surface 324.

Figure 3B:
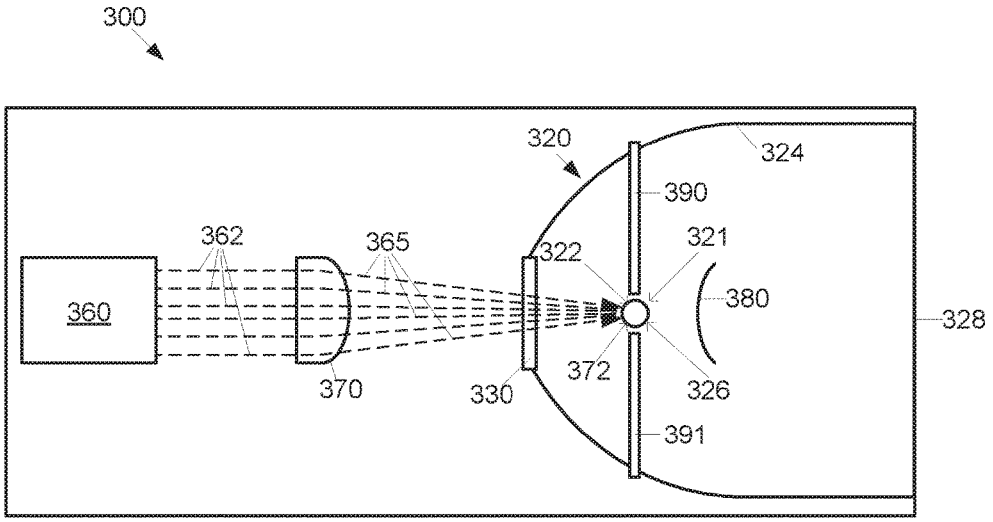
FIG. 3B is a schematic diagram of a first exemplary embodiment of a laser driven sealed beam lamp with electrodes.

As shown in FIG. 3B, a pair of ignition electrodes 390, 391 may be located in the proximity of the plasma ignition region 321. Returning to FIG. 3A, the interior surface and/or the exterior surface of the ingress window 330 may be treated to reflect the high intensity egress light 329 generated by the plasma, while simultaneously permitting passage of the ingress laser light 365 into the chamber 320.

The portion of the chamber 320 where laser light enters the chamber is referred to as the proximal end of the chamber 320, while the portion of the chamber 320 where high intensity light exits the chamber is referred to as the distal end of the chamber 320. For example, in the first embodiment, the ingress window 330 is located at the proximal end of the chamber 320, while the egress window 328 is located at the distal end of the chamber 320.

A convex hyperbolic reflector 380 may optionally be positioned within the chamber 320. The reflector 380 may reflect some or all high intensity egress light 329 emitted by the plasma at the plasma sustaining region 326 back toward the interior surface 324, as well as reflecting any unabsorbed portion of the ingress laser light 365 back toward the interior surface 324. The reflector 380 may be shaped according to the shape of the interior surface 324 to provide a desired pattern of high intensity egress light 329 from the egress window 328. For example, a parabolic shaped interior surface 324 may be paired with a hyperbolic shaped reflector 380. The reflector 380 may be fastened within the chamber 320 by struts (not shown) supported by the walls of the chamber 320, or alternatively, the struts (not shown) may be supported by the egress window 328 structure. The reflector 380 also prevents the high intensity egress light 329 from exiting directly through the egress window 328. The multiple reflections of the laser beam past the focal plasma point provide ample opportunity to attenuate the laser wavelengths through properly selected coatings on reflectors 380, interior surface 324 and egress window 328. As such, the laser energy in the high intensity egress light 329 can be minimized, as can the laser light reflected back to the laser 360. The latter minimizes instabilities when the laser beam interferes within the chamber 320.

The use of reflector 380 at preferably an inverse profile of the interior surface 324, ensure that no photons, regardless of wavelength, exit the egress window 328 through direct line radiation. Instead, all photons, regardless of wavelength, exit the egress window 328 bouncing off the interior surface 324. This ensures all photons are contained in the numerical aperture (NA) of the reflector optics and as such can be optimally collected after exiting through the egress window 328. The non-absorbed IR energy is dispersed toward the interior surface 324 where this energy may either be absorbed over a large surface for minimal thermal impact or reflected towards the interior surface 324 for absorption or reflection by the interior surface 324 or alternatively, reflected towards the egress window 328 for pass-through and further processed down the line with either reflecting or absorbing optics.

The laser light source 360 may be a single laser, for example, a single infrared (IR) laser diode, or may include two or more lasers, for example, a stack of IR laser diodes. The wavelength of the laser light source 360 is preferably selected to be in the near-IR to mid-IR region as to optimally pump the ionizable medium, for example, Xenon gas. A far-IR light source 360 is also possible. A plurality of IR wavelengths may be applied for better coupling with the absorption bands of the gas. Of course, other laser light solutions are possible, but may not be desirable due to cost factors, heat emission, size, or energy requirements, among other factors.

It should be noted that while it is generally taught it is preferable to excite the ionizing gas within 10 nm of a strong absorption line, this is not required when creating a thermal plasma, instead of fluorescence plasma. Therefore, the Franc-Condone principle does not necessarily apply. For example, ionizing gas may be excited CW at 1070 nm, 14 nm away from a very weak absorption line (1% point, 20 times weaker in general than lamps using fluorescence plasma, for example, at 980 nm emission with the absorption line at 979.9 nm at the 20% point. However a 10.6 μm laser can ignite Xenon plasma even though there is no known absorption line near this wavelength. In particular, $CO_2$ lasers can be used to ignite and sustain laser plasma in Xenon. See, for example, U.S. Pat. No. 3,900,803.

Figure 10:
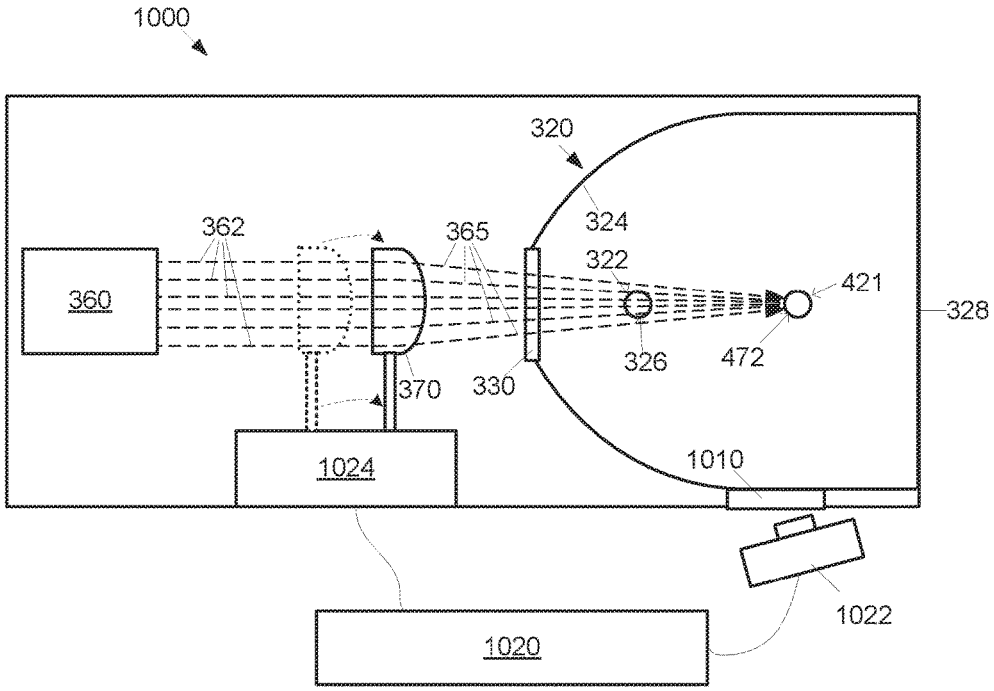
FIG. 10 is a schematic diagram of a feedback control system for a laser driven sealed beam lamp.

The path of the laser light 362, 365 from the laser light source 360 through the lens 370 and ingress window 330 to the lens focal region 372 within the chamber 320 is direct. The lens 370 may be adjusted to alter the location of the lens focal region 372 within the chamber 320. For example, as shown by FIG. 10, a controller 1020 may control a focusing mechanism 1024 such as an electronic or electro/mechanical focusing system. Alternatively, the controller 1020 may control a focusing mechanism integral to the laser light source 360. The controller 1020 may be used to adjust the lens focal region 472 to ensure that the lens focal region 472 coincides with the focal point 322 of the interior surface 324, so that the plasma sustaining region 326 is stable and optimally located.

The controller 1020 may maintain the desired location of the lens focal region 472 in the presence of forces such as gravity and/or magnetic fields. The controller 1020 may incorporate a feedback mechanism to keep the focal region and/or plasma arc stabilized to compensate for changes. The controller 1020 may monitor the location of the plasma ignition region 421, for example, using a tracking device 1022, such as a camera. The camera 1022 may monitor the location of the plasma through a flat monitor window 1010 located in the wall of the sealed chamber 320, as described later. The controller 1020 may further be used to track and adjust the location of the focal point between the current location and a desired location, and correspondingly, the location of the plasma, for example, between an ignition region and a sustaining region, as described further below. The tracking device 1022 feeds the position/size/shape of the plasma to the controller, which in turn controls the focusing mechanism to adjust the position/size/shape of the plasma. The controller 1020 may be used to adjust the location of the focal range in one, two, or three axis. As described further below, the controller 1020 may be implemented by a computer.

Figure 4A:
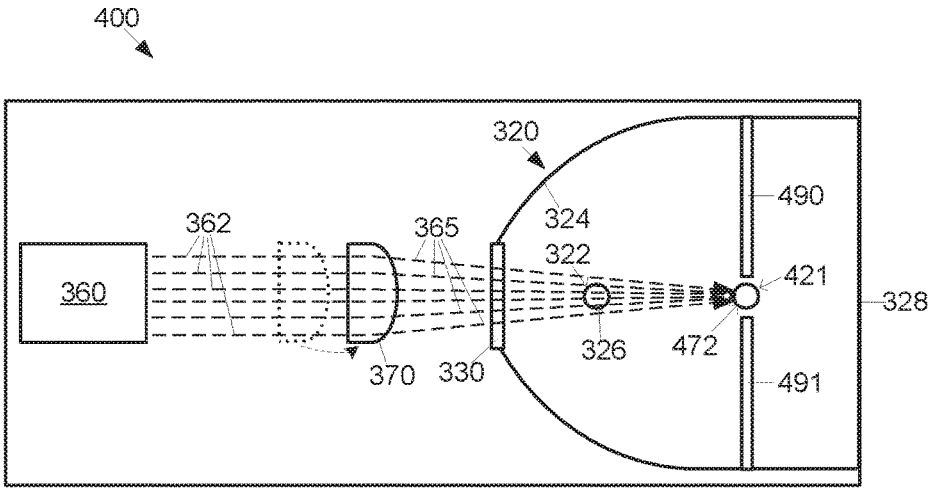
FIG. 4A is a schematic diagram of a second exemplary embodiment of a laser driven sealed beam lamp showing a first focal region.
Figure 4B:
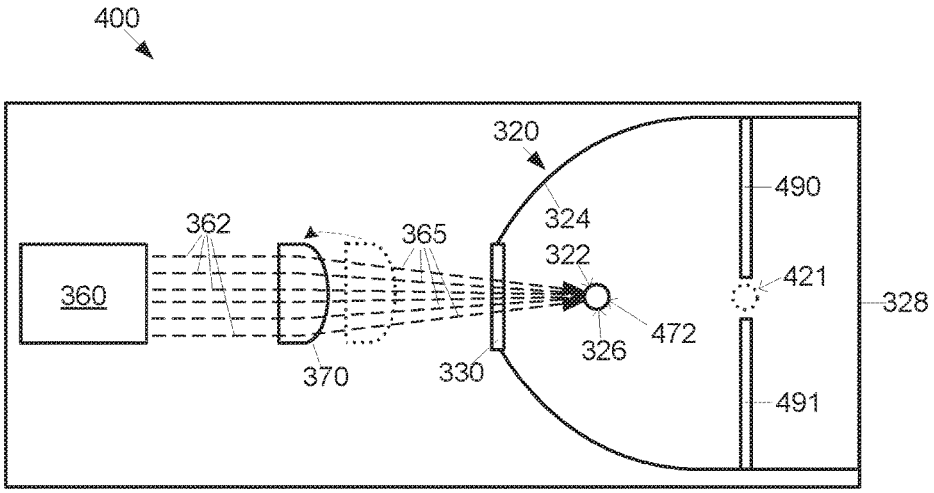
FIG. 4B is a schematic diagram of a second exemplary embodiment of a laser driven sealed beam lamp showing a second focal region.

Under a second exemplary embodiment of a laser driven sealed beam lamp 400, shown by FIGS. 4A-4B, the plasma sustaining region 326 and a plasma ignition region 421 are separately located in remote portions of the chamber 320. The elements of FIGS. 4A-4B having the same numbers as the elements of FIG. 3 are understood to be described according to the above description of the first embodiment.

A pair of ignition electrodes 490, 491 is located in the proximity of the plasma ignition region 421. The lens 370 is positioned, for example, by a control system (not shown), to an ignition position such that the lens focal region 472 coincides with the plasma ignition region 421 between the ignition electrodes 490, 491. The plasma ignition region 421 may be located, for example, at the distal end of the chamber 320, near the egress window 328 minimizing shadowing and/or light loss caused by the ignition electrodes 490, 491. After the plasma is ignited, for example by energizing the ignition electrodes 490, 491, the lens 370 may be gradually moved to a plasma sustaining position (indicated by a dotted outline in FIG. 4A) by adjusting the position of the lens focal region 472, so the plasma is drawn back to the focal point 322 of the chamber interior surface 324, such that the plasma sustaining region 326 is stable and optimally located at a proximal end of the chamber 320 to maximize high intensity light output. For example, the lens 370 may be mechanically moved to adjust the laser light focal location.

Locating the plasma sustaining region 326 remotely from the ignition region 421 allows location of the ignition electrodes 490, 491 for minimal shadowing of the light output and at the same time keeping the ignition electrodes 490, 491 a reasonable distance from the plasma discharge. This ensures minimal evaporation of the electrode material on the ingress window 330 window and the egress window 328 in the plasma and as a result, a longer practical lifetime of the lamp 400 is achieved. The increased distance from the plasma in relation to the ignition electrodes 490, 491 also helps in stabilizing the plasma as gas turbulence generated by the plasma may interfere in a reduced manner with the ignition electrodes 490, 491.

Figure 4C:
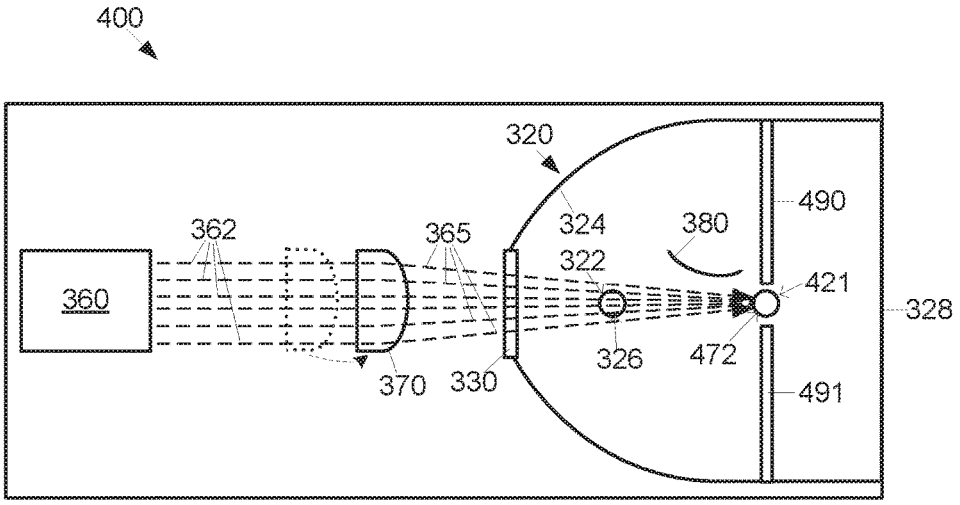
FIG. 4C is a schematic diagram of a second exemplary embodiment of a laser driven sealed beam lamp showing an optional reflector in an ignition position.
Figure 4D:
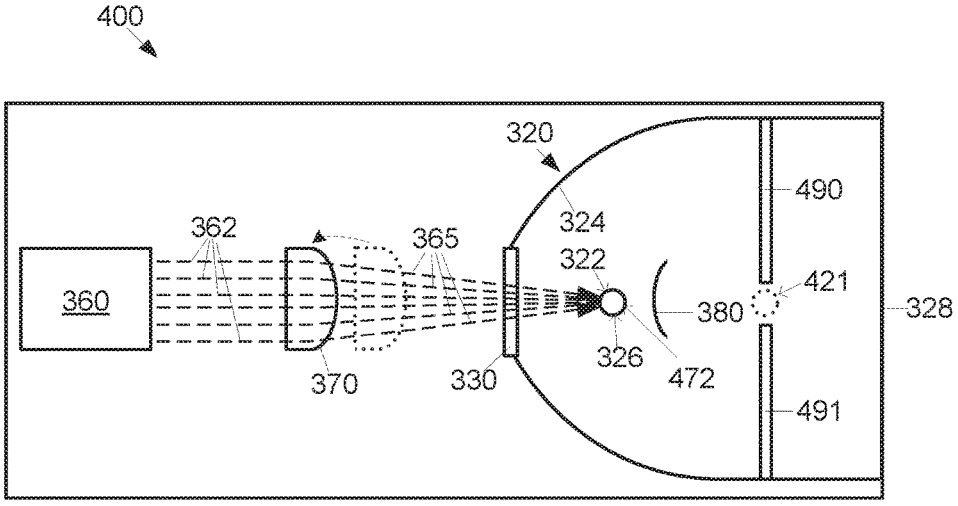
FIG. 4D is a schematic diagram of a second exemplary embodiment of a laser driven sealed beam lamp showing an optional reflector in a sustaining position.

FIGS. 4C and 4D show implementations of the second embodiment incorporating an optional reflector 380. The reflector 380 may be relocated between an ignition position, shown in FIG. 4C and a sustaining position, shown in FIG. 4D. The reflector 380 may be located in an ignition position out of the way of the path of the focused ingress laser light 365 from the ingress window 330 to the plasma ignition region 421. For example, the reflector 380 may be pivoted or retracted (translated) from the sustaining position shown in FIG. 4D, to the ignition position closer to the wall of the chamber interior surface 324, as shown in FIG. 4C.

Alternatively, the reflector 380 may remain stationary in the sustaining position as lens focal region 372 is adjusted. In such an embodiment, the location of the ignition electrodes 490, 491 may be closer to the proximal end of the chamber 320 than the distal end of the chamber 320.

Figure 4E:
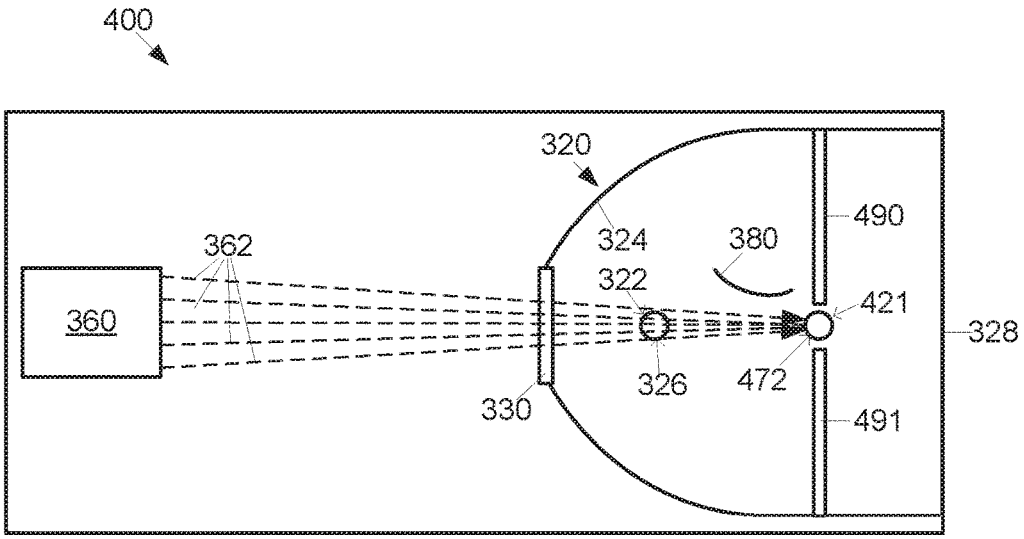
FIG. 4E is a schematic diagram of a variation of the second exemplary embodiment of a laser driven sealed beam lamp showing a first focal region.
Figure 4F:
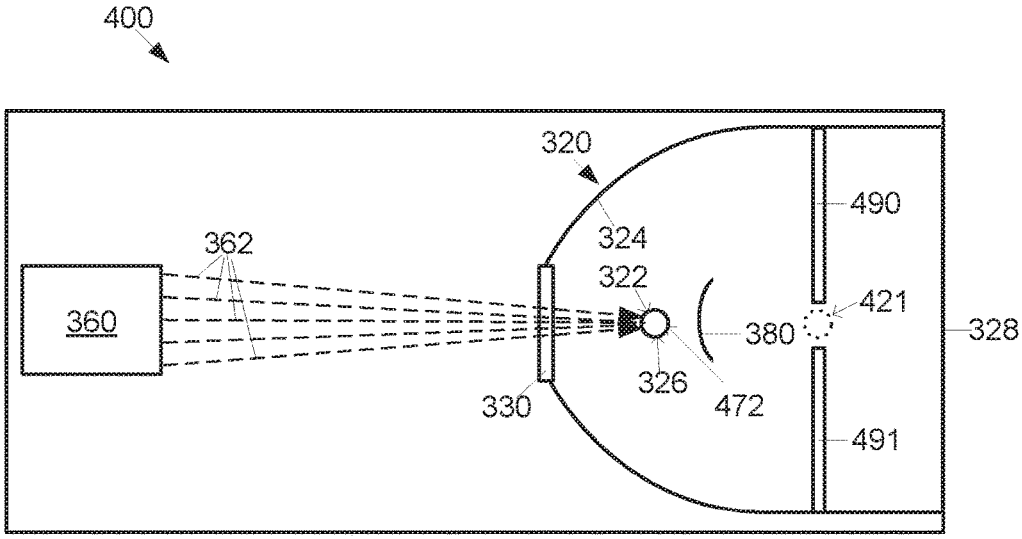
FIG. 4F is a schematic diagram of a variation of the second exemplary embodiment of a laser driven sealed beam lamp showing a second focal region.

FIGS. 4E and 4F show a variation of the second embodiment where the focal region 472 of the laser light 362 is adjusted using optics within the laser light source 360, rather than changing the focal region 472 of the laser light 362 with a lens 370 (FIG. 4A) between the laser light source 360 and the substantially flat ingress window 330. The substantially flat ingress window 330 may allow internal optics within the laser light source 360 to adequately control the size and location of the focal region 472 of the laser light 362 without an external lens 360, whereas under the prior art the Lansing effect of a curved ingress window may have necessitated use of an external lens 360.

Figure 5:
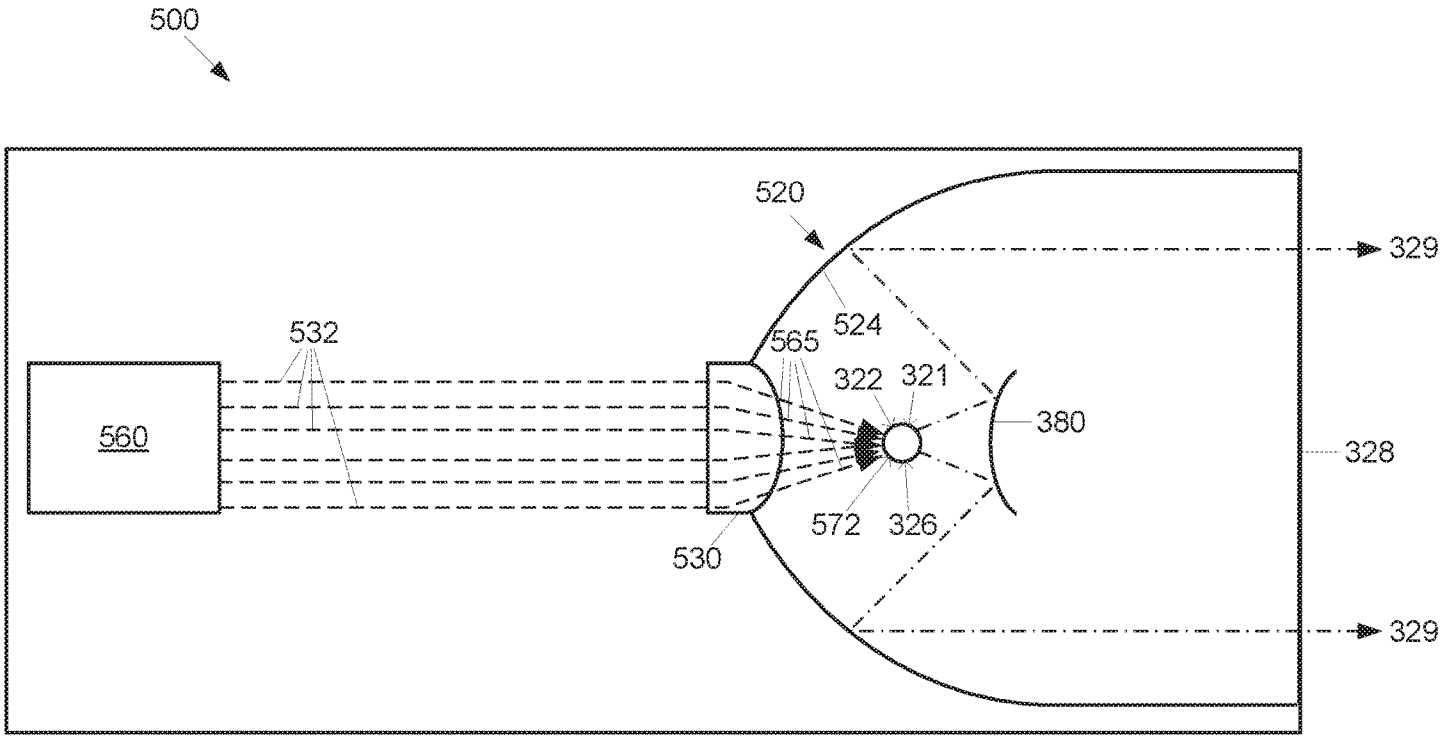
FIG. 5 is a schematic diagram of a third exemplary embodiment of a laser driven sealed beam lamp.

FIG. 5 shows a third exemplary embodiment of a laser driven sealed beam lamp 500. The lamp 500 includes a sealed chamber 520 configured to contain an ionizable medium, for example, Xenon, Argon or Krypton gas. The chamber 520 is generally pressurized, as described above regarding the first embodiment. The chamber 520 has an egress window 328 for emitting high intensity egress light 329. The egress window 328 may be formed of a suitable transparent material, for example quartz glass or sapphire, and may be coated with a reflective material to reflect specific wavelengths. This may be a partial reflection or spectral reflection, for example to filter unwanted wavelengths from the light emitted by the lamp 500. A coating on the egress window 328 that reflects the wavelength of ingress laser light 565 may lower the amount of energy needed to maintain plasma within the chamber.

The chamber 520 has an integral reflective chamber interior surface 524 configured to reflect high intensity light toward the egress window 328. The interior surface 524 may be formed according to a shape appropriate to maximizing the amount of high intensity light reflected toward the egress window 328, for example, a parabolic or elliptical shape, among other possible shapes. In general, the interior surface 524 has a focal point 322, where high intensity light is located for the interior surface 524 to reflect an appropriate amount of high intensity light. The high intensity light 329 output by the lamp 500 is emitted by plasma formed of the ignited and energized ionizable medium within the chamber 520. The ionizable medium is ignited within the chamber 520 by one of several means, as described above.

While under the first embodiment, the chamber 320 (FIG. 3) has a substantially flat ingress window 330 (FIG. 3) disposed within a wall of the interior surface 324 (FIG. 3), and a lens 370 (FIG. 3) disposed in the path between the laser light source 360 (FIG. 3) and the ingress window, under the third embodiment the functions of the ingress window 330 (FIG. 3) and the lens 370 (FIG. 3) are performed in combination by an ingress lens 530.

The ingress lens 570 is disposed in the path between the laser light source 560 and an ingress lens focal region 572 within the chamber 520. For example, the ingress lens 570 may be configured to direct collimated laser light 532 emitted by the laser light source 560 to the ingress lens focal region 572. In the third embodiment, the ingress lens focal region 572 is co-located with the plasma sustaining region 326, the plasma ignition region 321, and the focal point 322 of the interior surface 524. The interior surface and/or the exterior surface of the ingress lens 530 may be treated to reflect the high intensity light generated by the plasma, while simultaneously permitting passage of the laser light 565 into the chamber 520.

The lamp 500 may include internal features such as a reflector 380 and high intensity egress light paths 329 as described above regarding the first embodiment. The path of the laser light 532, 565 from the laser light source 360 through the ingress lens 530 to the lens focal region 572 within the chamber 520 is direct. In the third embodiment there is no glass wall between the ingress lens 530 and the sealed chamber 520 as the ingress lens 530 is doubling as an ingress window. This provides for a shorter possible distance between ingress lens 530 and plasma than what is possible with prior art lamps. As such, lenses with a shorter focal length can be utilized. The latter affects the range of focal beam waste profiles that can be achieved in an attempt to create a smaller plasma region, coupling more efficiently into small apertures.

Figure 6:
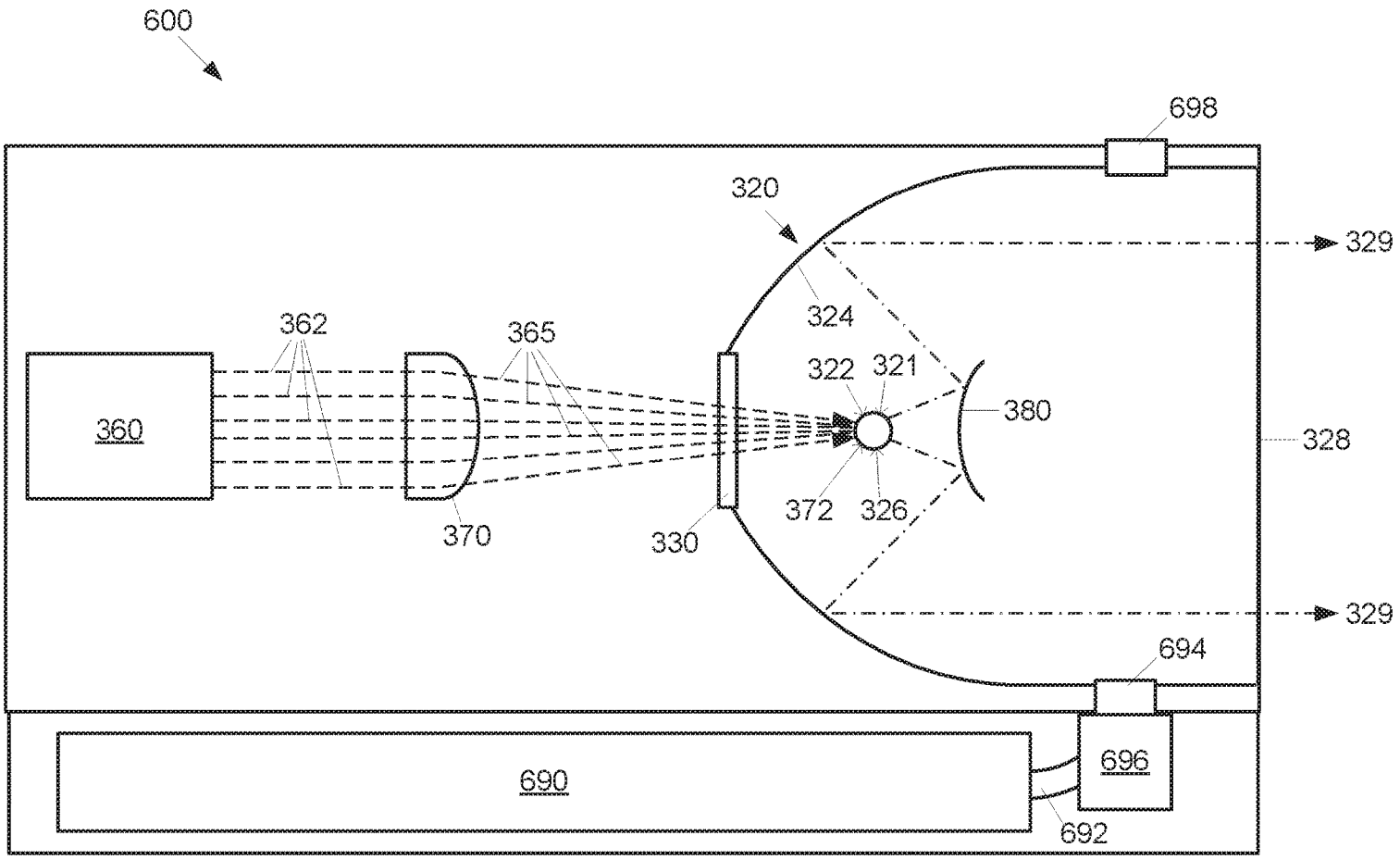
FIG. 6 is a schematic diagram of a fourth exemplary embodiment of a laser driven sealed beam lamp.

A fourth exemplary embodiment of a laser driven sealed beam lamp 600 as shown by FIG. 6 may be described as a variation on the first and third embodiments where the plasma is ignited using energy from a laser disposed outside the sealed chamber. Under the fourth embodiment, laser light 362, 365 is directed into the sealed chamber by an integral lens 530 (FIG. 5) or an external lens 370. In order to facilitate ignition of the ionizable medium within the chamber, the pressure within the chamber may be adjusted, as described further below.

Under the fourth embodiment, the focal region 372 of the laser 360 may be either fixed or movable. For example, if electrodes are used to assist in the ignition of the laser, the focal region 372 may be movable so that a first focal region is located between ignition electrodes (not shown), and a second focal region (not shown) is located away from the ignition electrodes (not shown) so the ignition electrodes (not shown) are not in close proximity to the burning plasma. In this example, the pressure within the sealed chamber 320 may be varied (increased or decreased) while the focal region 372 is moved from the first focal region to the second focal region.

In another example, the pressure in the chamber 320 may be adjusted such that the ionizable medium may be ignited solely by the ingress laser light 365, so that ignition electrodes (not shown) may be omitted from the chamber 320, and the focal region is substantially the same during both plasma ignition and plasma sustaining/regeneration.

Under the fourth embodiment, dynamic operating pressure change is affected within the sealed chamber 320, for example, starting the ignition process when the chamber 320 has very low pressure, even below atmospheric pressure. The initial low pressure facilitates ignition of the ionizable medium and by gradually increasing the fill pressure of the chamber 320, the plasma becoming more efficient and produces brighter light output as pressure increases. The pressure may be varied within the sealed chamber 320 using several means, described below.

The sealed lamp 600 includes a reservoir chamber 690 filled with pressurized Xenon gas having an evacuation/fill channel 692. A pump system 696 connects the reservoir chamber 690 with the lamp chamber 320 via a gas ingress fill valve 694. Upon ignition the Xenon fill pressure in the lamp chamber 320 is held at a first level, for example, a sub atmosphere level. When the laser 360 ignites the Xenon forming a low pressure plasma, the pump system 696 increases the pressure within the lamp chamber 320. The pressure within the lamp 600 may be increased to a second pressure level, for example a level where the high intensity egress light 329 output from the plasma reaches a desirable intensity. After the lamp 600 is extinguished, the pump system 696 may reverse and fill the reservoir chamber 690 with the Xenon gas from the lamp chamber 320. This type of pressure system may be advantageous for systems where the light source is maintained at high intensity levels for a long duration.

The Xenon high pressure reservoir 690 may be connected to the lamp chamber 320 through the fill channel 692. An exhaust channel may be provided on the lamp 600 to release the pressure, for example, with a controlled high pressure valve 698. Lamp ignition starts by exhausting all Xenon gas to air in the lamp 600, ensuring ignition under atmospheric Xenon conditions. After ignition is established, the fill valve 694 opens and the lamp chamber 320 is filled with Xenon gas until equilibrium with the Xenon container is achieved.

In an alternative embodiment, a metal body refectories laser driven Xenon lamp is connected to a cooling system, for example, a liquid nitrogen system, through cooling channels in the metal body. Prior to ignition, the Xenon gas is liquefied and collects at the bottom of the lamp. This process may take a relatively short about of time, for example on the order of about a minute. Plasma ignition is caused by a focused laser beam igniting the Xenon, and the heat generated by the plasma converts the Xenon liquid into high pressure Xenon gas. The pressure level may be determined in several ways, for example, by the cold fill pressure of the lamp. Other types of cooling systems are possible, providing they are sufficient to cool Xenon gas to a temperature of −112° C. For atmospheric Xenon. Higher pressure Xenon can be turned to liquid at temperatures of −20° C. It should be noted that the variable pressure system described in the fourth embodiment is also applicable to other embodiments herein, for example, the third embodiment with the integral lens, as well as the embodiments described below.

Figure 7A:
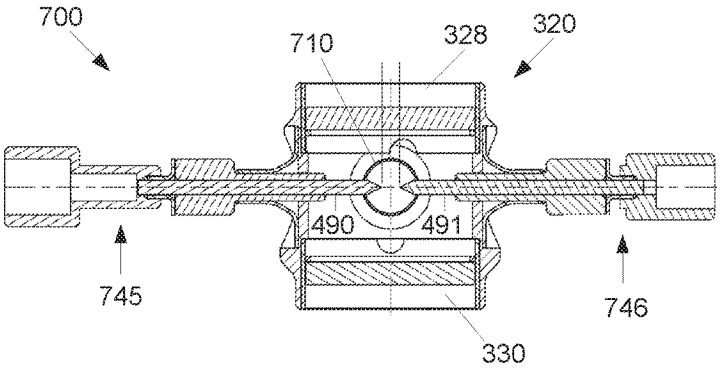
FIG. 7A is a schematic diagram of a fifth exemplary embodiment of a laser driven sealed beam lamp having a side viewing window.
Figure 7B:
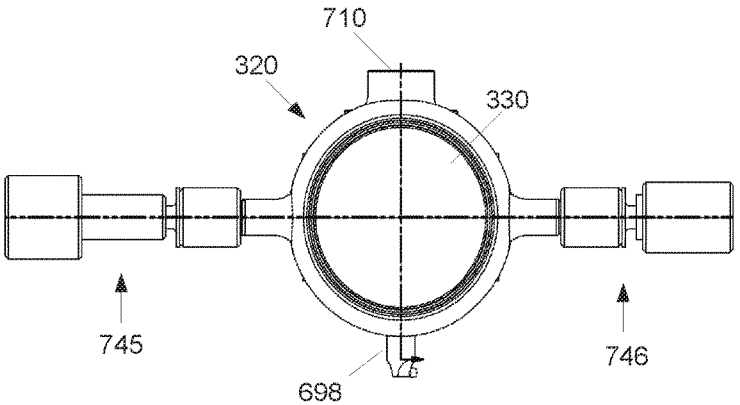
FIG. 7B is a schematic diagram of a fifth embodiment of FIG. 7A from a second view.
Figure 7C:
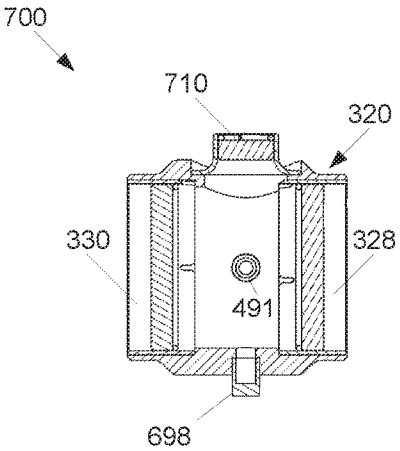
FIG. 7C is a schematic diagram of a fifth embodiment of FIG. 7A from a third view.

A fifth exemplary embodiment of a laser driven sealed beam lamp 700 as shown by FIGS. 7A-7C may be described as a variation on the previously described embodiments where the plasma ignition region is monitored via a side window. It should be noted that FIGS. 7A-7C omit the laser and optics external to the sealed chamber 320.

FIG. 7A shows a first perspective of the fifth embodiment of a cylindrical lamp 700. Two arms 745, 746 protrude outward from the sealed chamber 320. The arms 745, 746 house a pair of electrodes 490, 491, made out of a material able to withstand the ignition temperature such as tungsten or thoriated tungsten, which protrude inward into the sealed chamber 320, and provide an electric field for ignition within the chamber 320. Electrical connections for the electrodes 490, 491 are provided at the ends of the arms 745, 746.

As with the previous embodiments (excepting the third embodiment), the chamber 320 has a substantially flat ingress window 330 where laser light from a laser source (not shown) may enter the chamber 320. Similarly the chamber 320 has a substantially flat egress window 328 where high intensity light from ignited plasma may exit the chamber 320. The interior of the chamber 320 may have a reflective inner surface, for example, a parabolic reflective inner surface, and may include a reflector (not shown), such as a hyperbolic reflector described above, disposed within the chamber 320 between the egress window 328 and the electrodes 490, 491.

The fifth embodiment includes a viewing window 710 in the side of the sealed chamber 320. The viewing window 710 may be used to monitor the location of the plasma ignition and/or sustaining location, generally corresponding to the laser focal location, as described above. As described previously, a controller may monitor one or more of these points and adjust the laser focal location accordingly to correct for external forces such as gravity or electronic and/or magnetic fields. The viewing window 710 may also be used to help relocate the focal point of the laser between a first position and a second position, for example, between an ignition position and a sustaining position. In general, it is desirable for the viewing window 710 to be substantially flat to reduce optical distortion in comparison with a curved window surface and provide a more accurate visual indication of the positions of locations within the chamber 320. For example, the viewing window 710 may be formed of sapphire glass, or other suitably transparent materials.

FIG. 7B shows a second perspective of the fifth embodiment, by rotating the view of FIG. 7A ninety degrees vertically. A controlled high pressure valve 698 is located substantially opposite the viewing window 710. However, in alternative embodiments the controlled high pressure valve 698 need not be located substantially opposite the viewing window 710, and may be located elsewhere on the wall of the chamber 320. FIG. 7C shows a second perspective of the fifth embodiment, by rotating the view of FIG. 7B ninety degrees horizontally.

Under the fifth embodiment, the lamp 700 may be formed of sapphire or nickel-cobalt ferrous alloy, also known as Kovar™, without use of any copper in the construction, including braze materials. The flat egress window 328 improves the quality of imaging of the plasma spot over a curved egress window by minimizing aberrations. The use of relatively high pressure within the chamber 320 under the fifth embodiment provides for a smaller plasma focal point 321, resulting in improved coupling into smaller apertures, for example, an optical fiber egress.

Under the fifth embodiment, the electrodes 490, 491 may be separated by a larger distance than prior art sealed lamps, for example, larger than 1 mm, to minimize the impact of plasma gas turbulence damaging the electrodes 490, 491. The electrodes 490, 491 may be symmetrically designed to minimize the impact on the plasma gas turbulence caused by asymmetrical electrodes.

While the previous embodiments have generally described lamps with light egress through a window, other variations of the previous embodiments are possible. For example, a sealed lamp with a laser light ingress window may channel the egress high intensity light from the plasma to a second focal point, for example, where the high intensity light is collected into a light guide, such as a fiber optic device.

Figure 12:
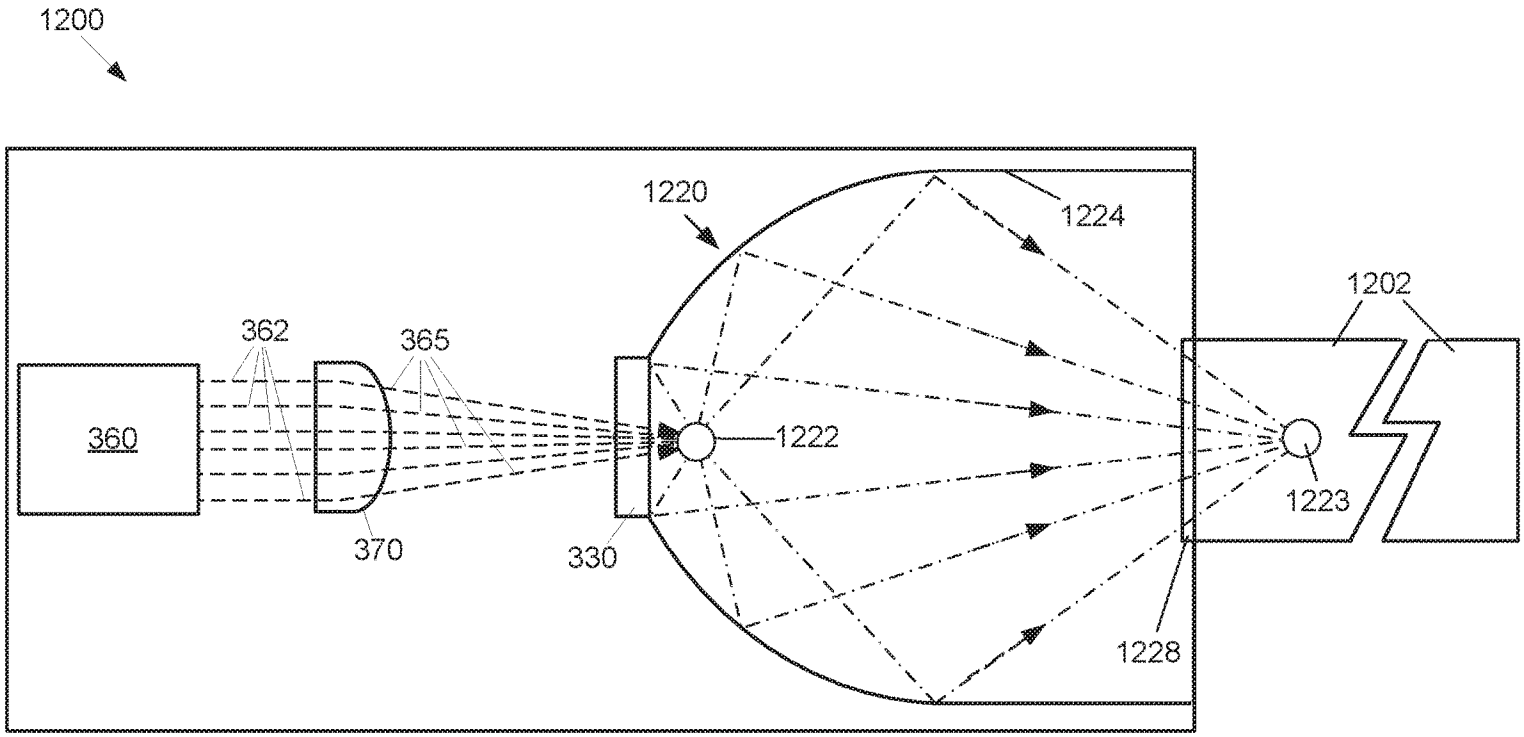
FIG. 12 is a schematic diagram of a sixth exemplary embodiment of a laser driven sealed beam lamp with an elliptical internal reflector.

FIG. 12 is a schematic diagram of a sixth exemplary embodiment of a laser driven sealed beam lamp 1200 with an elliptical internal reflector 1224. As with the previous embodiments, the lamp 1200 includes a sealed chamber 1220 configured to contain an ionizable medium. Laser light 362, 365 from the laser light source 360 is directed through the lens 370 and ingress window 330 to the lens focal region, where the plasma is formed. The lens focal region coincides with a first focal region 1222 of the elliptical internal reflector 1224. The chamber 1220 has an egress window 1228 for emitting high intensity egress light to a second, external focal point 1223. The egress window 1228 may be formed of a suitable transparent material, for example quartz glass or sapphire, and may be coated with a reflective material to reflect specific wavelengths. As shown, a second, egress focal region 1223 may be outside the lamp 1200, for example, through the small egress window 1228 into a light guide 1202. Smaller sized egress windows may be advantageous over larger sized egress windows, for example due to being less costly while allowing coupling into fiber, light guides and integrating rods directly preferably without additional focusing optics.

While FIG. 12 shows the second focal region 1223 external to the lamp 1220, the second focal region 1223 from the elliptical reflector 1224 may also be inside the lamp 1200 directed at the face of an integrating light guide. It should be understood that when the diameter of the integrating light guide is small, this light guide may be considered to be a "fiber."

Further, the shape of the focal point may be adjusted according to the type of egress used with the lamp 1200. For example, a rounder shaped focal point may provide more light into a smaller egress (fiber). The integral elliptic reflector 1224 may be used for providing a focal region egress, rather than collimated egress, for example, a lamp having a parabolic integral reflector. While not shown in FIG. 12, the sixth embodiment lamp 1200 may optionally include an internal reflector 380 (FIG. 5), for example, located between the first focal region 1222 and the second focal region 1223 to ensure that all rays arrive at the second focal point within the numerical aperture (NA) of the elliptical reflector 1224.

Figure 13:
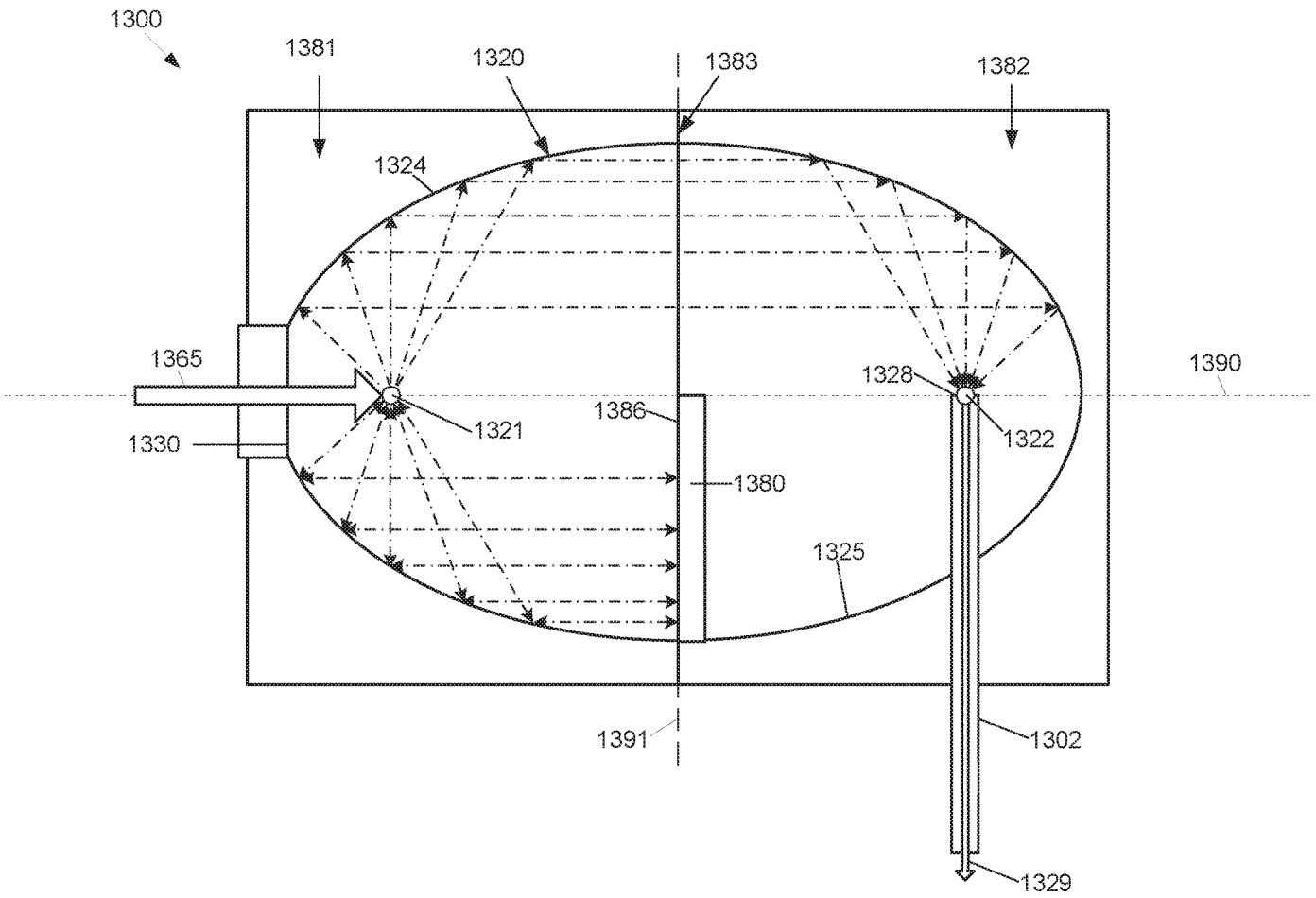
FIG. 13 is a schematic drawing of a seventh embodiment of a dual parabolic lamp configuration with 1:1 imaging from the reflector arc onto an integrating light guide or fiber, or both.

A focal egress region lamp may be configured as a dual parabolic configuration with 1:1 imaging of the focal point onto a small fiber rather than using a sapphire egress window. FIG. 13 is a schematic drawing of a cross section of a seventh exemplary embodiment showing a simplified dual parabolic lamp 1300 configuration with 1:1 imaging from the arc of the interior surface of the chamber 1320 onto an integrating light guide/rod or fiber 1302, both. An ingress surface 1330, for example, a window or lens, provides ingress for laser light 1365 into a pressurized sealed chamber 1320. The chamber 1320 includes a first integral parabolic surface 1324 and a second integral parabolic surface 1325, configured in a symmetrical configuration, such that the curve of the first integral parabolic surface 1324 is substantially the same as the curve of the second integral parabolic surface 1325 across a vertical axis of symmetry 1391. However, in alternative embodiments, the first integral parabolic surface 1324 and the second parabolic surface 1325 may be asymmetrical across the vertical axis 1391.

The ingress surface 1330 is associated with the first integral parabolic surface 1324. An egress surface 1328 is associated with the second integral parabolic surface 1325. The egress surface 1328 may be, for example, the end of a waveguide 1302 such as an optical fiber, providing high intensity light egress from the sealed chamber 1320. The egress surface 1328 may be located away from the second integral parabolic surface 1325, for example, at or near a horizontal axis of symmetry 1390.

A first focal region 1321 corresponds to a focus point of the first parabolic surface 1324, and a second focal region 1322 corresponds to a focus point of the second parabolic surface 1325. The laser light 1365 enters the pressurized sealed chamber 1320 via the ingress surface 1330, and is directed to provide energy to the plasma of the energized ionized material within the chamber 1320 at the first focal region 1321. The plasma may be ignited substantially as described in the previous embodiments. The plasma produces a high intensity light 1329, for example, visible light, which is reflected within the chamber 1320 by the first integral parabolic surface 1324 and the second parabolic surface 1325 directly or indirectly toward the egress surface 1328. The egress surface 1328 may coincide with the second focal region 1322.

A mirror 1380 may be located within the chamber 1320, having a reflective surface 1386 located between the first focal region 1321 and the second focal region 1322. The reflective surface 1386 may be oriented to back-reflect the lower half of the radiation within the chamber 1320 back to the first focal region 1321 via the first parabolic reflector 1324. The mirror reflective surface 1386 may be substantially flat, for example, to direct light back to the parabolic reflective surface 1324, or curved, to direct the light directly to the first focal region 1321. The laser light 1365, for example the AIR portion of the spectrum feeds the plasma located at the first focal region 1321 with more energy while the high intensity light produced by the plasma, passes through thin opaque sections of the plasma onto the upper part of the first parabolic reflector 1324 and is then reflected by the second parabolic reflector 1325 for egress through the egress surface 1328 of the light guide or optical fiber 1302.

As shown in FIG. 13, the ingress laser light 1365 may enter the chamber 1320 via the ingress surface 1330 in an orientation parallel to the horizontal axis of symmetry 1390, and the egress high intensity light 1329 may exit the chamber 1320 via the egress window 1329 in an orientation parallel to the vertical axis of symmetry 1391. However, in alternative embodiments, the ingress laser light 1365 and/or the egress high intensity light 1329 may have different orientations. The position and/or orientation of the mirror 1380 may change according to the corresponding orientations of the ingress light 1365 and/or egress light 1329.

The chamber 1320 may be formed of a first section 1381 including the first integral parabolic surface 1324 and a second section 1382 including the second integral parabolic surface 1325. The first section 1381 and the second section 1382 are attached and sealed at a central portion 1383. Additional elements described previously, for example, a gas inlet/outlet, electrodes and/or side windows, may also be included, but are not shown for clarity.

The interior of the chamber 1320 has been referred to as having the first integral parabolic surface 1324 and the second integral parabolic surface 1325. However, the interior of the chamber 1320 may be thought of as a single reflective surface, having a first parabolic portion 1324 with a first focal region 1321 located at the plasma ignition and/or sustaining region and a second parabolic portion 1325 with a second focal region 1322 located at the egress surface 1328 of the integrating rod 1302.

The dual parabolic reflector lamp 1300 is preferably made out of oxygen free copper, and the reflective surfaces 1324, 1325 are preferably diamond turned and diamond polished for highest accuracy in demanding applications. Electrodes (not shown), for example, formed of tungsten and/or thoriated tungsten may be provided to assist in igniting the ionizable media within the chamber 1320. Power levels may range from, for example, 35 W to 50 KW. Implementation of lamps 1300 at the higher end of the power range may include additional cooling elements, for example, water cooling elements. The lamp 1300 may have a fill pressure ranging from, but not limited to 20 to 80 bars.

Figure 14A:
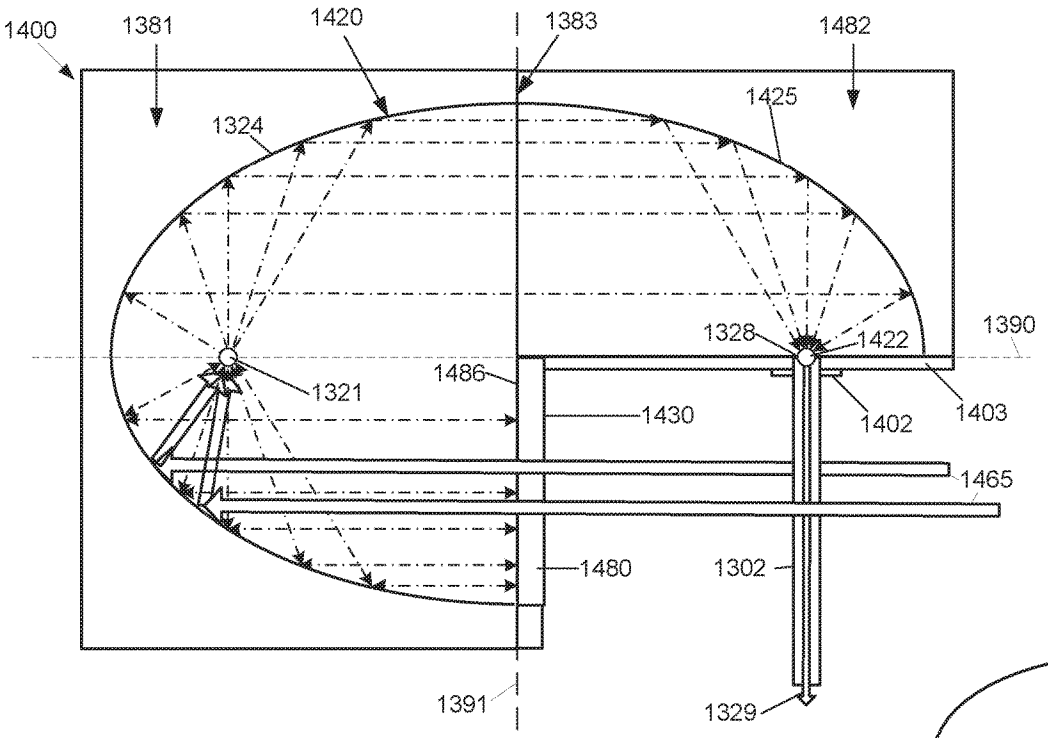
FIG. 14A is a schematic drawing of an eighth embodiment of a dual parabolic lamp configuration with 1:1 imaging from the reflector arc onto an integrating light guide or fiber, or both.

FIG. 14A is a schematic drawing of an eighth embodiment of a dual parabolic lamp 1400 with 1:1 imaging from the reflector arc onto an integrating light guide 1302. The eighth embodiment 1400 is similar to the seventh embodiment 1300 (FIG. 13). Elements in FIG. 14 having the same element numbers as elements in FIG. 13 are as described above regarding the seventh embodiment.

Figure 14B:
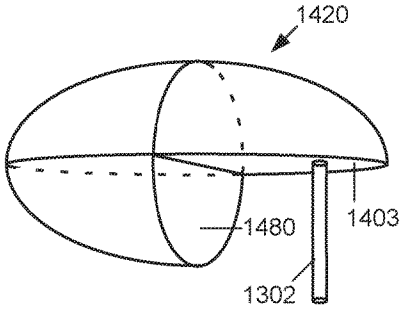
FIG. 14B is a schematic drawing of the eighth embodiment of the dual parabolic lamp shown in FIG. 14A.

In contrast with the seventh embodiment, under the eighth embodiment the dual parabolic lamp 1400 removes the ingress surface 1330 (FIG. 13) from the apex of the first integral parabolic surface 1324. As shown by FIG. 14B, a quadrant of the sealed chamber 1320 (FIG. 13) may be removed, so that a sealed chamber 1420 of the dual parabolic lamp 1400 under the eighth embodiment is sealed by a mirror 1480 and a horizontal planar sealing surface 1403. Returning to FIG. 14A, an additional seal 1402 for the chamber 1420 may be formed around the integrating light guide 1302 between the integrating light guide and the horizontal planar sealing surface 1403. Collimated laser light 1465 enters the chamber 1420 through an ingress surface 1430 of the mirror 1480. The mirror 1480 admits the collimated laser light 1465 from outside the chamber 1420 and reflects high intensity light and laser light 1465 within the chamber 1420. The egress surface 1328 may be located away from the second integral parabolic surface 1425, for example, within the planar sealing surface 1403, where the planar sealing surface 1403 may be parallel to the horizontal axis of symmetry 1390.

A first focal region 1321 corresponds to a focus point of the first parabolic surface 1324, and a second focal region 1422 corresponds to a focus point of the second parabolic surface 1425. The collimated laser light 1465 enters the pressurized sealed chamber 1420 via the ingress surface 1430 of the mirror 1480, and is reflected by the first parabolic surface 1324 toward the first focal region 1321. The collimated laser light 1465 provides energy to a plasma of the energized ionized material within the chamber 1420 at the first focal region 1321. The plasma may be ignited substantially as described in the previous embodiments. The plasma produces a high intensity light, for example, visible light, which is reflected within the chamber 1420 by the first integral parabolic surface 1324 and the second parabolic surface 1325 directly or indirectly toward the egress surface 1328. The egress surface 1328 may coincide with the second focal region 1422.

The reflective surface 1486 may be oriented to back-reflect the lower half of the radiation within the chamber 1420 back to the first focal region 1321 The high intensity light produced by the plasma passes through thin opaque sections of the plasma onto the upper part of the first parabolic reflector 1324 and is then reflected by the second parabolic reflector 1425 for egress through the egress surface 1328 of the light guide or optical fiber 1302.

The chamber 1320 may be formed of a first section 1381 including the first integral parabolic surface 1324 and a second section 1482 including the second integral parabolic surface 1425. The first section 1381 and the second section 1382 may be attached and sealed at a central portion 1383. Additional elements, for example, a gas inlet/outlet, electrodes and/or side windows, may also be included, but are not shown for clarity.

The interior of the chamber 1420 has been referred to as having the first integral parabolic surface 1324 and the second integral parabolic surface 1425. However, the interior of the chamber 1420 may be a single reflective surface, having a first parabolic portion 1324 with a first focal region 1321 located at the plasma ignition and/or sustaining region and a second parabolic portion 1425 with a second focal region 1422 located at the egress surface 1328 of the integrating rod 1302.

In contrast with the seventh embodiment, the eighth embodiment avoids any hole or gap in the curved reflector surface 1324 by relocating the laser light ingress location to the mirror surface 1430, thereby maintaining homogeneity throughout the optical system. Although input and output rays cross orthogonally, there is no interference as the collimated laser light input 1365 is generally IR and the output light 1329 is generally visible and/or NIR. Since the laser beam 1465 enters the chamber 1420 expanded and collimated, the lower half of the first parabolic reflector 1324 is used as the focusing mechanism to generate the laser plasma. In a practical application the expanded and collimated laser beam(s) 1465 may cross but not interact with the exit fiber 1302. For example, as shown in FIG. 14A, there may be a laser beam at each side of the fiber guide 1302. Further, each one of these laser beams 1465 may have a different wavelength.

The dual parabolic reflector lamp 1400 is preferably made out of oxygen free copper, and the reflective surfaces 1324, 1425 are preferably diamond turned and diamond polished for highest accuracy in demanding applications. Electrodes (not shown), for example, formed of tungsten and/or thoriated tungsten may be provided to assist in igniting the ionizable media within the chamber 1420. Power levels may range from, for example, 35 W to 50 KW. Implementation of lamps 1400 at the higher end of the power range may include additional cooling elements, for example, water cooling elements. The lamp 1400 may have a fill pressure ranging from, but not limited to 20 to 80 bars.

While FIGS. 14A-14B depict the chamber 1420 sealed at planes corresponding to the vertical axis 1391 and the horizontal axis 1390, other sealing configurations are possible. For example, the mirror 1480 may be extended further toward or up to the second focal region 1422, and/or the horizontal planar sealing surface 1403 may be lowered below the second focal region 1422. In alternative embodiments, sealing surface 1403 need not be planar or oriented horizontally.

Figure 15A:
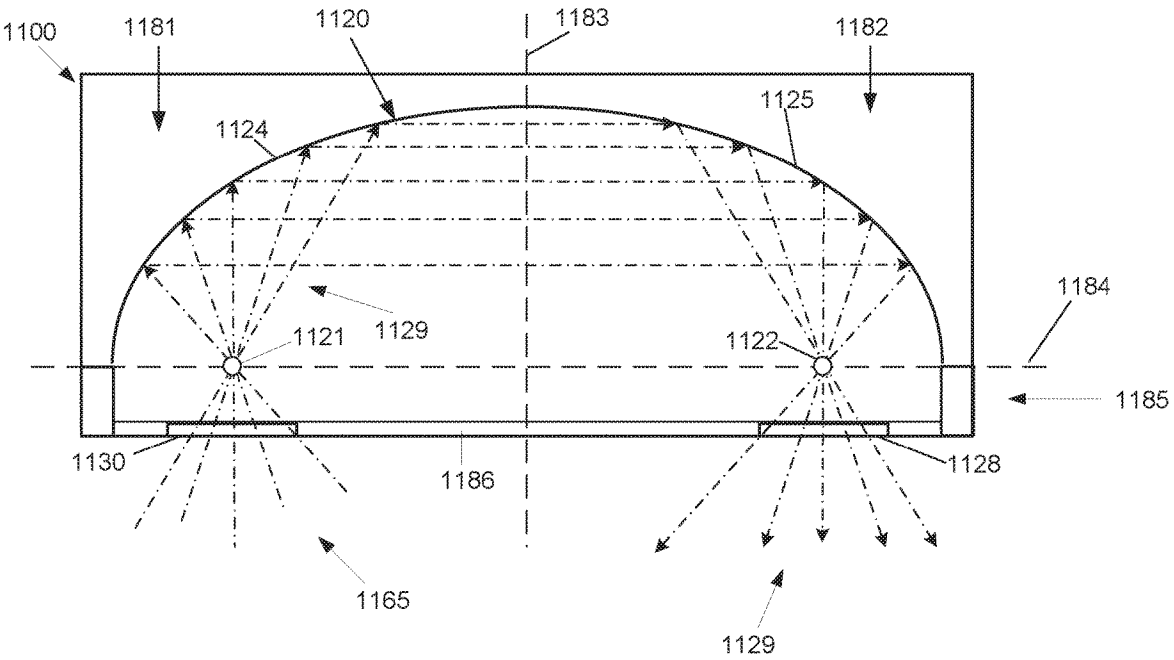
FIG. 15A is a schematic drawing of a ninth embodiment of a dual parabolic lamp configuration with parallel ingress and egress windows.

FIG. 15A is a schematic drawing of a ninth embodiment of a dual parabolic lamp 1100. The lamp 1100 includes a sealed, pressurized reflective chamber 1120 configured to contain an ionizable medium, for example, but not limited to Xenon gas, Argon gas, or Krypton gas. The chamber 1120 may be formed of a first parabolic quadrant 1181, a second parabolic quadrant 1182, and an extending portion 1185. The first parabolic quadrant 1181 includes a reflective first integral parabolic contoured surface 1124, the second parabolic quadrant 1182 includes a reflective second integral parabolic contoured surface 1125, and the extending portion 1185 includes an interface surface 1186.

The first parabolic quadrant 1181 and the second parabolic quadrant 1182 may abut at a dividing line 1183. While the first parabolic quadrant 1181 and the second parabolic quadrant 1182 are depicted as being substantially equally sized under the ninth embodiment, in alternative embodiments the first parabolic quadrant 1181 and the second parabolic quadrant 1182 may not be equally sized.

The first parabolic quadrant 1181 and the second parabolic quadrant 1182 may be integrally formed, or may be independently formed and joined at the dividing line 1183. In alternative embodiments, the second parabolic quadrant 1182 may not directly abut one another. For example, there may be a second extending portion (not shown) disposed between first parabolic quadrant 1181 and the second parabolic quadrant 1182.

The extending portion 1185 extends from a parabolic baseline 1184 away from the parabolic quadrants 1181, 1182 to the interface surface 1186. The extending portion 1185 may be integrally formed with the first parabolic quadrant 1181 and/or the second parabolic quadrant 1182, or may be independently formed and joined with the first parabolic quadrant 1181 and/or the second parabolic quadrant 1182. Additional elements described in previous embodiments, for example, a gas inlet/outlet, electrodes and/or side windows, may also be included, but are not shown in FIG. 15A for clarity.

Ingress light 1165 enters the chamber 1120 through an ingress surface 1130 of the interface surface 1186. The interface surface 1186 admits the ingress light 1165 from outside the chamber 1120 and may reflect light within the chamber 1120. The ingress surface 1130 may be, for example, a lens, a planar window, or an interface to an optical fiber or an integrating light guide/rod (not shown). The egress surface 1128 may be located within the interface surface 1186, where the interface surface 1186 may be parallel to the parabolic baseline 1184.

A first focal region 1121 corresponds to a focus point of the first parabolic surface 1124, and a second focal region 1122 corresponds to a focus point of the second parabolic surface 1125. The ingress light 1165, for example, a laser beam, provides energy to a plasma of the energized ionized material within the chamber 1120 at the first focal region 1121. The plasma may be ignited substantially as described in the previous embodiments. The plasma produces a high intensity light, for example, visible light, which is reflected within the chamber 1120 by the first integral parabolic surface 1124 and the second parabolic surface 1125 directly or indirectly toward the egress surface 1128. In alternative embodiments, the egress surface 1128 may coincide with the second focal region 1122. The egress surface 1128 may be a window, or another optical interface, for example, a lens or an interface surface of an optical fiber or an integrating light guide/rod (not shown).

The interior of the chamber 1120 has been referred to as including the first integral parabolic surface 1124 and the second integral parabolic surface 1125. However, the interior of the chamber 1120 may be a single reflective surface, having a first parabolic portion 1124 with a first focal region 1121 located at the plasma ignition and/or sustaining region and a second parabolic portion 1125 with a second focal region 1122 located near or at the egress surface 1128 of the interface surface 1186. Like the eighth embodiment, the ninth embodiment avoids any hole or gap in the integral parabolic surfaces 1124, 1125 by locating the laser light ingress within the interface surface 1186, thereby maintaining homogeneity throughout the optical system.

The dual parabolic reflector lamp 1100 may be formed of a reflecting metal, such as aluminum or silver, or another metal, such as oxygen free copper, coated with a reflective surface appropriate for the application. Alternatively, the lamp 1100 may be formed by embedding a reflecting metal such as oxygen free copper or aluminum reflectors in a Kovar® shells to work for semi-conductor applications.

Electrodes (not shown), for example, formed of tungsten and/or thoriated tungsten may be provided to assist in igniting the ionizable media within the chamber 1120. For example, one or more electrodes (not shown) may extend from outside the lamp 1100 into the sealed chamber 1120 in the vicinity of the first focal region 1121. Power levels of the lamp 1100 may range from, for example but not limited to, 35 W to 50 KW. Implementation of lamps 1100 at the higher end of the power range may include additional cooling elements, for example, water cooling elements (not shown). The lamp 1100 may have a fill pressure ranging from, but not limited to 20 to 80 bars.

The interface surface 1186 may have optical properties appropriate to the application. For example, the interface surface 1186 may be reflective to specified wave bands, be absorbing to specified wave bands, be diffusing to specified wave bands, and/or may have other optical properties. The interface surface 1186 may be formed of a transparent material, for example, sapphire or quartz, and coated with a reflective, diffusing, or absorbing material, except at the ingress surface 1130 and the egress surface 1128, where the interface surface remains uncoated and transparent. For example, the ingress surface 1130 may be coated with a substance such that the ingress surface 1130 admits laser light wavelengths and reflects high intensity light produced by ignited plasma of the media within the chamber 1120. Similarly, the egress surface 1128 may be coated such that the egress surface 1128 conveys the high intensity light 1129, but reflects other wavelengths, such as the wavelength(s) of the ingress laser light 1165.

Alternatively, the interface surface 1186 may be formed of a non-transmissive material, while the ingress surface 1130 and the egress surface 1128 are formed as windows within the interface surface 1186. The ingress surface 1130 and the egress surface 1128 may be formed of a material transparent to ingress light 1165 and/or egress light 1129, for example, sapphire, glass, or quartz that may be coated with a material appropriate for the application. While the interface surface 1186 is depicted as being substantially planar, in alternative embodiments the interface surface 1186 may have different configurations, for example, a curved surface or a bi-level surface so that a first distance between the first focal region 1121 and the ingress surface 1130 may not be the same as a second distance between the second focal region 1122 and the egress surface 1128. Further, the ingress surface 1130 and the egress surface 1128 may not be parallel and/or may not be coplanar in alternative embodiments.

Figure 15B:
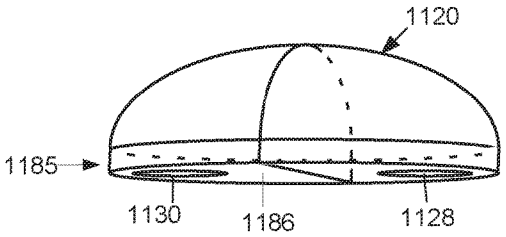
FIG. 15B is a schematic drawing in perspective view of the ninth embodiment of the dual parabolic lamp shown in FIG. 15A.
Figure 16A:
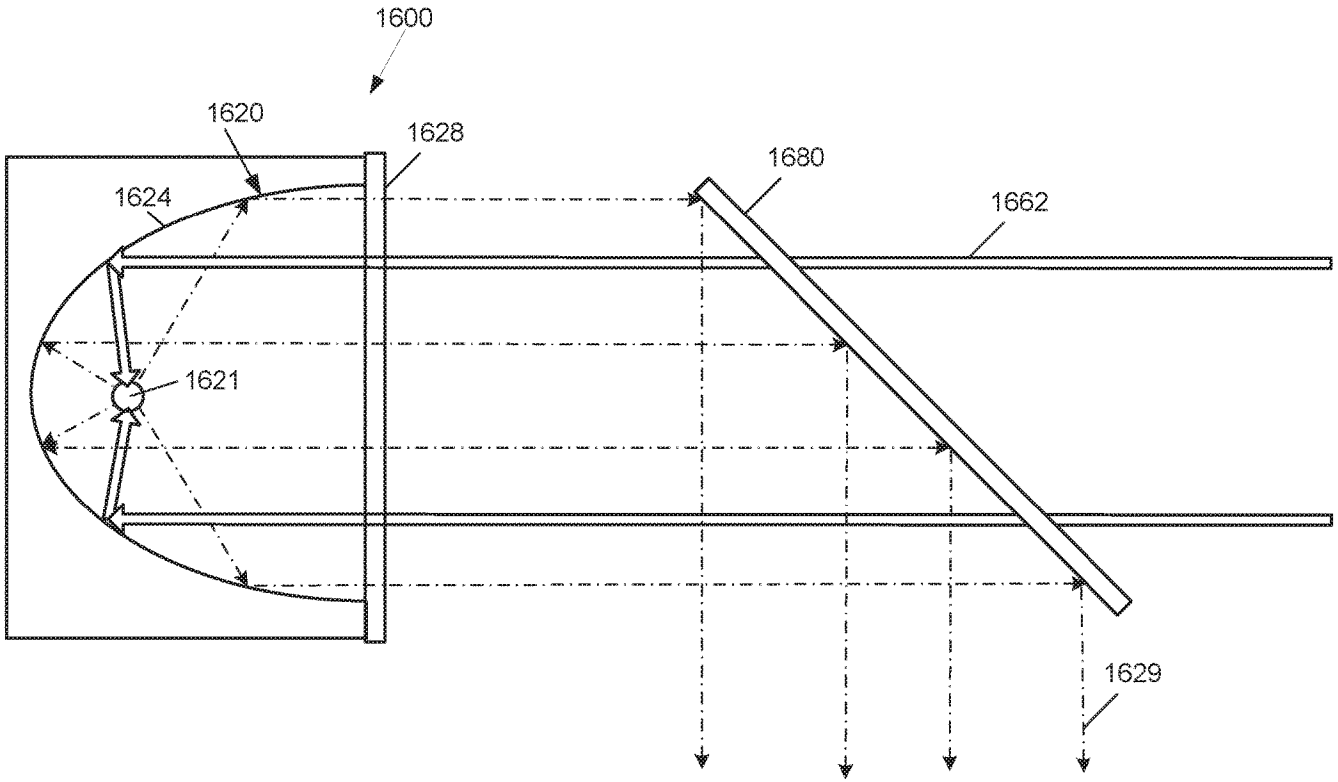
FIG. 16A (PRIOR ART)
FIG. 16A is a schematic drawing of a prior art parabolic lamp configuration.
Figure 16B:
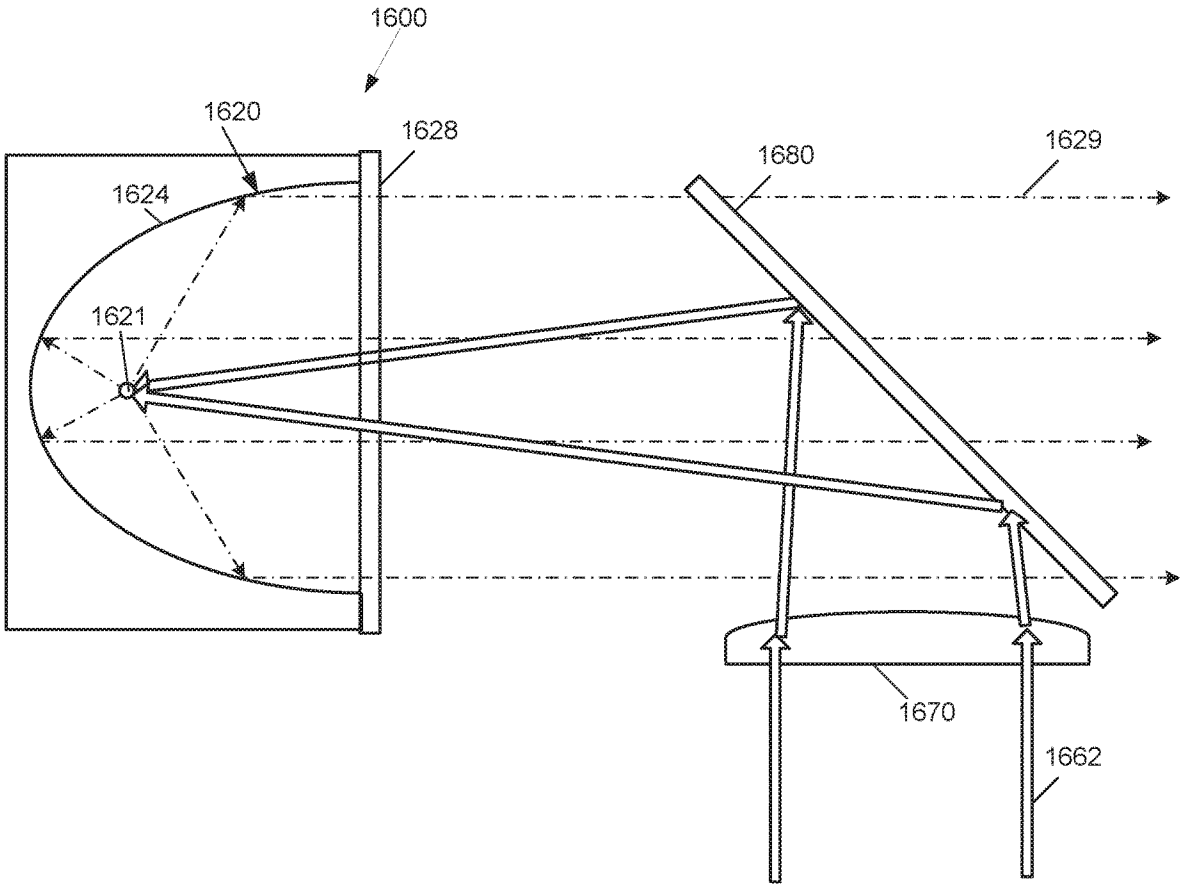
FIG. 16B (PRIOR ART)
FIG. 16B is a schematic drawing of a prior art parabolic lamp configuration adding a focusing ingress lens to the lamp of FIG. 16A.

While FIGS. 15A-15B depict the chamber 1120 sealed at a plane parallel to the parabolic baseline 1184, other sealing configurations are possible. For example, the interface surface 1186 may be positioned nearer to or farther away from the parabolic baseline, to accommodate larger or smaller plasma volumes at one or both of the focal regions 1121, 1122.

The ingress light 1165 entering the lamp 110 may be, for example, a focused ingress beam or a collimated ingress beam. For example, the ingress surface 1130 may be configured to receive a collimated beam, where the ingress surface 1130 is configured, for example as a lens to focus the collimated beam to the first focal region 1121. Alternatively, the ingress surface 1130 may be configured as a planar surface, where an external optical element (not shown) is configured to focus the ingress light to the first focal region 1121. In addition, the ingress window surface 1130 may be planar, admitting a collimated ingress beam that is reflected by the first integral parabolic surface 1124 and the reflective second integral parabolic surface 1125 toward the second focal region 1122.

An advantage of the dual parabolic lamps 1100, 1300, 1400 operated in this orientation is that the plasma plume is in line with gravity direction. This minimizes the corona plume impact on the mostly circular plasma front.

Figure 17A:
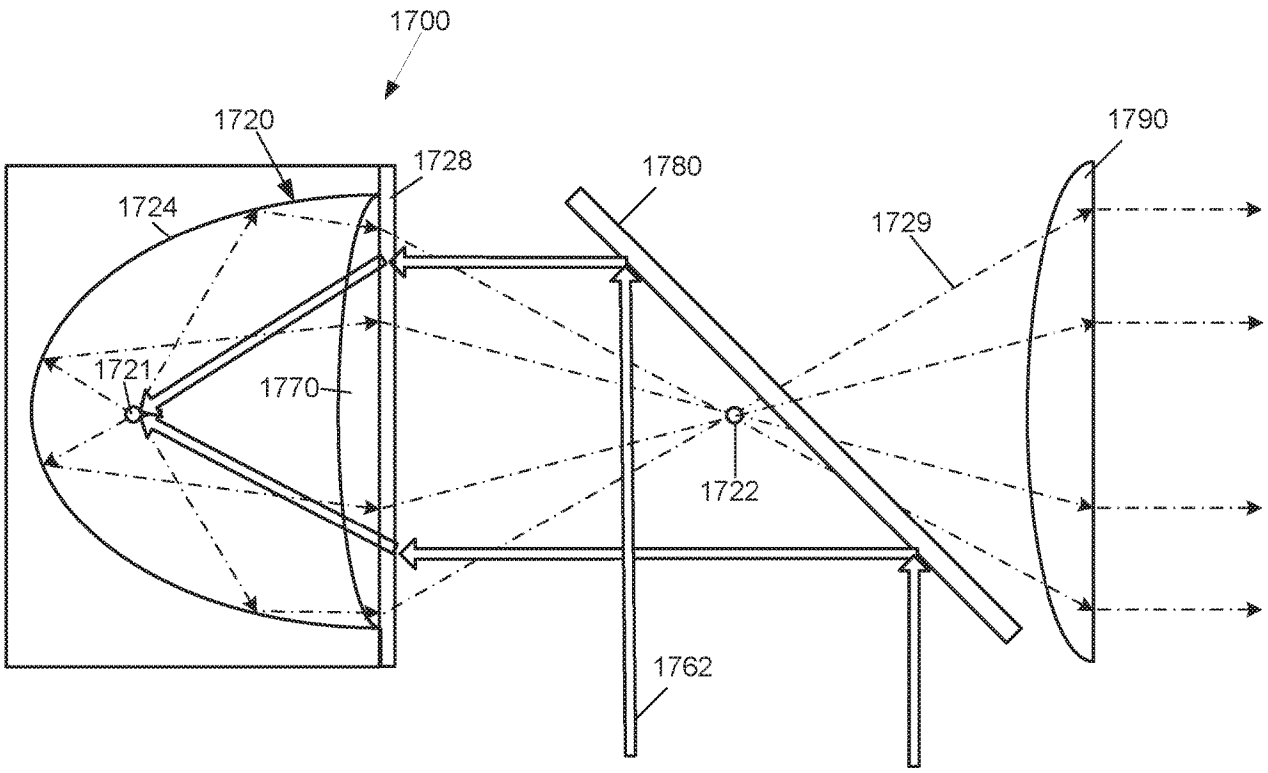
FIG. 17A is a schematic drawing of a tenth embodiment of an elliptical lamp configuration with an integral lens and an external collimating and/or expanding lens.

As mentioned previously, it is desirable to minimize the size of the plasma at the focal region of the lamp, but challenging to do so by focusing ingress laser light using the reflective interior surface of the lamp chamber. This is easier and more economical to achieve with lenses rather than mirrors. FIG. 17A is a schematic drawing of a tenth exemplary embodiment of an elliptical lamp 1700 configuration with an integral lens 1770 and an external collimating lens 1790.

The lamp 1700 includes a sealed, pressurized reflective chamber 1720 configured to contain an ionizable medium, for example, but not limited to Xenon gas, Argon gas, or Krypton gas. Under the tenth embodiment a focusing and lens 1770 is positioned between a folding mirror 1780 and a reflective surface 1724 of the lamp chamber 1720 in such a way that an expanded and collimated laser beam 1729 is focused at a first focal point 1721 of the reflective surface 1724 and the high intensity light 1729 generated by the plasma at the first focal point 1721 is focused by same lens 1770 toward a second focal point 1722 and passes through the folding mirror 1780. Under the tenth embodiment, the reflective surface 1724 has an elliptical contour with a focal length that is substantially similar to a focal length of the lens 1770. The lens 1770 is positioned between the first focal point 1721 and a second focal point 1722 of the elliptical reflective surface 1724. The collimating lens 1790 is positioned to receive the high intensity light 1729 after it has passed through the folding mirror 1780 and to collimate the high intensity light 1729. Alternatively, or in addition, the collimating lens 1790 may expand the high intensity light 1729. This allows for appropriate optical control after the lamp 1700 has generated the photons of the high intensity light 1729.

If the lens 1770 serves as the interface window for the lamp, as shown in FIG. 17A, the lens 1770 is preferably an a sphere Sapphire lens. However, it may be less expensive for the lens 1770 to be formed of another material and integrated into the lamp. The lens 1770 may alternatively be positioned between a planar interface window 1728 and the chamber 1720.

The folding mirror 1780 may be a dichroic beam splitter that will generate parallax shift for the rays passing through it. The parallax shift may be reduced, for example, by using a very thin substrate, or the use of a dichroic beam splitter cube (not shown) (also used as beam combiner) where the inner surface is reflective coated and the dispersion characteristics of the transparent material used is chosen for the optical properties of the light source.

Figure 17B:
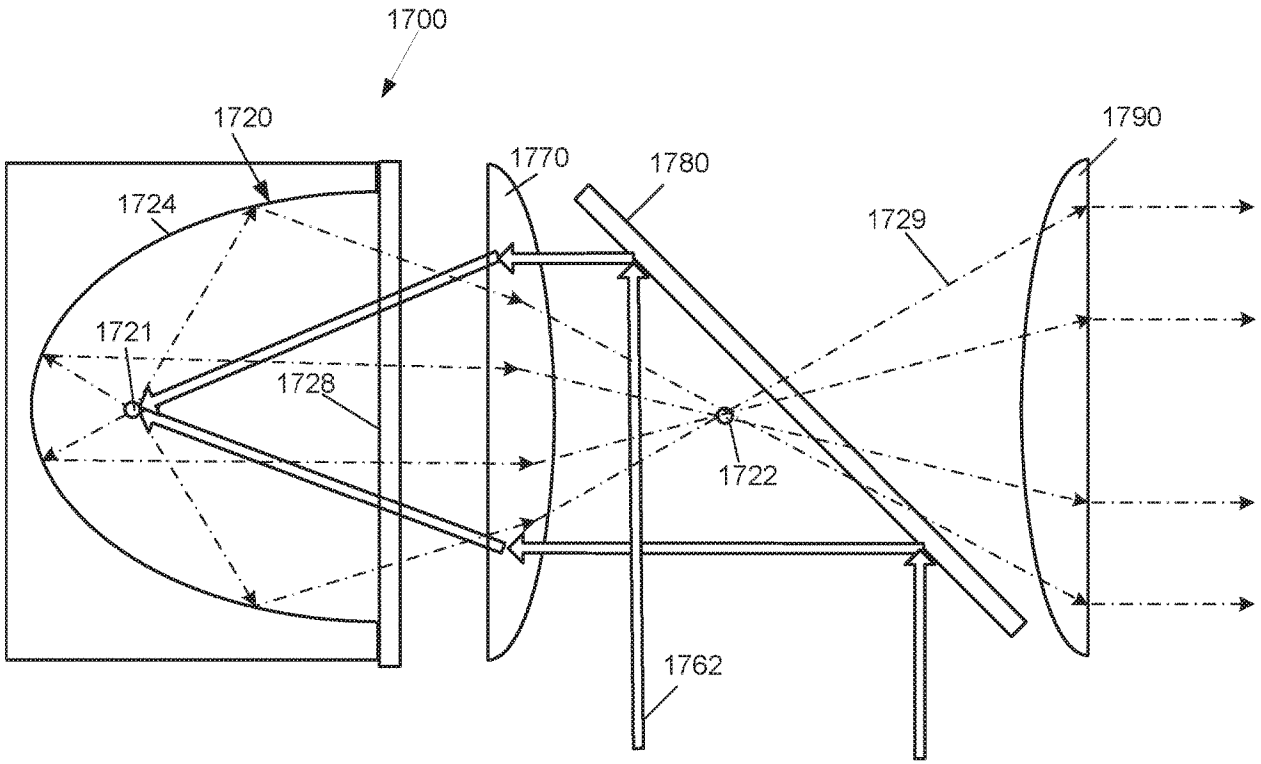
FIG. 17B is a schematic drawing of the tenth embodiment of an elliptical lamp configuration with an external lens and an external collimating and/or expanding lens.

While FIG. 17A depicts the lens 1770 as serving as the egress and ingress interface surface of the chamber 1720, FIG. 17B shows an alternative embodiment where the interface window 1728 is distinct from the lens 1770. While FIG. 17B shows a space between the interface window 1728 and the lens 1770, the interface window 1728 may optionally abut the lens 1770. Positioning the lens 1770 outside the chamber 1720 may be advantageous, as the lens 1770 is not subject to higher operating temperatures within the chamber 1720.

Figure 17C:
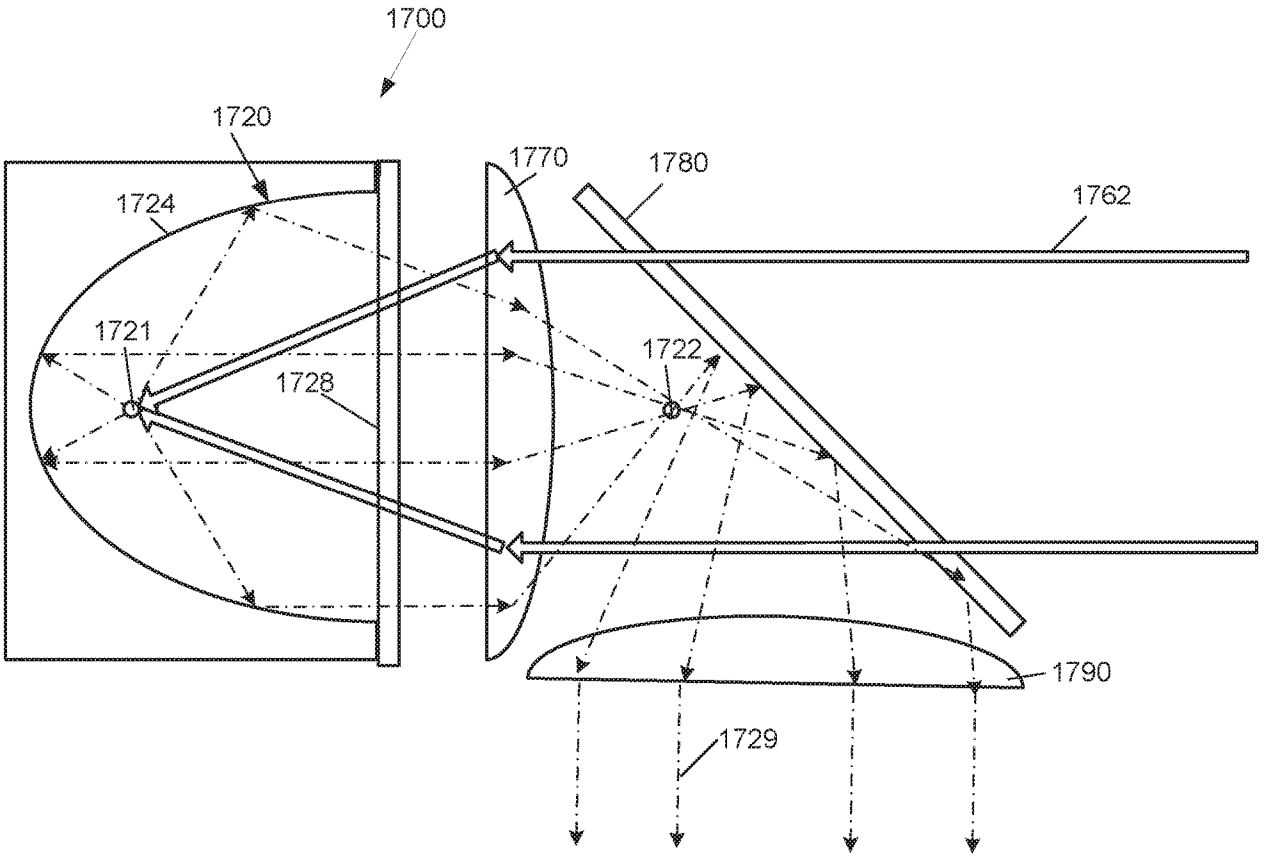
FIG. 17C is a schematic drawing of the tenth embodiment of an elliptical lamp configuration where the laser light is direct and the emitted light is reflected.

FIGS. 17A and 17B depict an embodiment where the laser light 1762 is reflected by the folding mirror 1780, and the high intensity light 1728 passes through the folding mirror 1780. In contrast, an alternative embodiment shown by FIG. 17C shows an embodiment where the high intensity light 1729 is reflected by the folding mirror 1780, and the laser light 1762 passes through the folding mirror 1780 toward the collimating and/or expanding lens 1790. The wavelengths that are passed and/or reflected by the folding mirror 1780 may be selected based on, for example, a coating applied to one or both surfaces of the folding mirror 1780.

The lamp 1700 may be formed of a reflecting metal, such as aluminum or silver, or another metal, such as oxygen free copper, coated with a reflective surface appropriate for the application. Alternatively, the lamp 1700 may be formed by embedding a reflecting metal such as oxygen free copper or aluminum reflectors in a Kovar® shells to work for semiconductor applications.

Electrodes (not shown), for example, formed of tungsten and/or thoriated tungsten may be provided to assist in igniting the ionizable media within the chamber 1720. For example, one or more electrodes (not shown) may extend from outside the lamp 1700 into the sealed chamber 1720 in the vicinity of the first focal region 1721. Power levels of the lamp 1700 may range from, for example but not limited to, 35 W to 50 KW. Implementation of lamps 1700 at the higher end of the power range may include additional cooling elements, for example, water cooling elements (not shown). The lamp 1700 may have a fill pressure ranging from, but not limited to 20 to 80 bars.

Under the tenth embodiment and the abovementioned alternative embodiments, it may be possible to significantly reduce the volume for ignition of the ionizable medium at the focal region of the lamp by focusing ingress laser light with the lens 1770. As a result, plasma ignition may be possible at lower pressures, and/or using lower laser power, and/or without the use of ignition aids, such as, but not limited to electrodes (not shown).

It should be noted that orientation of the lenses 1770, 1790 shown in FIGS. 17A-17C may be an appropriate orientation for Plano-aspheric lenses, although persons having ordinary skill in the art will recognize that one or the other or both of the lenses 1770, 1790 may have its orientation reversed according to the application at hand, as aspheric lenses may be unpredictable in the collection and focusing efficiencies in either direction.

Lamps configured with adjustable focal points are able to optimize focal point position(s) with the integral reflector system for egress according to the type (wavelength) of light to be emitted. For example, a 1:1 imaging technique may provide loss less (or nearly loss less) light transfer from plasma to fiber.

One or more of the embodiments described above may incorporate a system specific feedback loop with adjustable optics to allow for adjustable beam profiling in the application where needed. The optics may be adjusted in one, two or three axis, depending upon the application.

Figure 8:
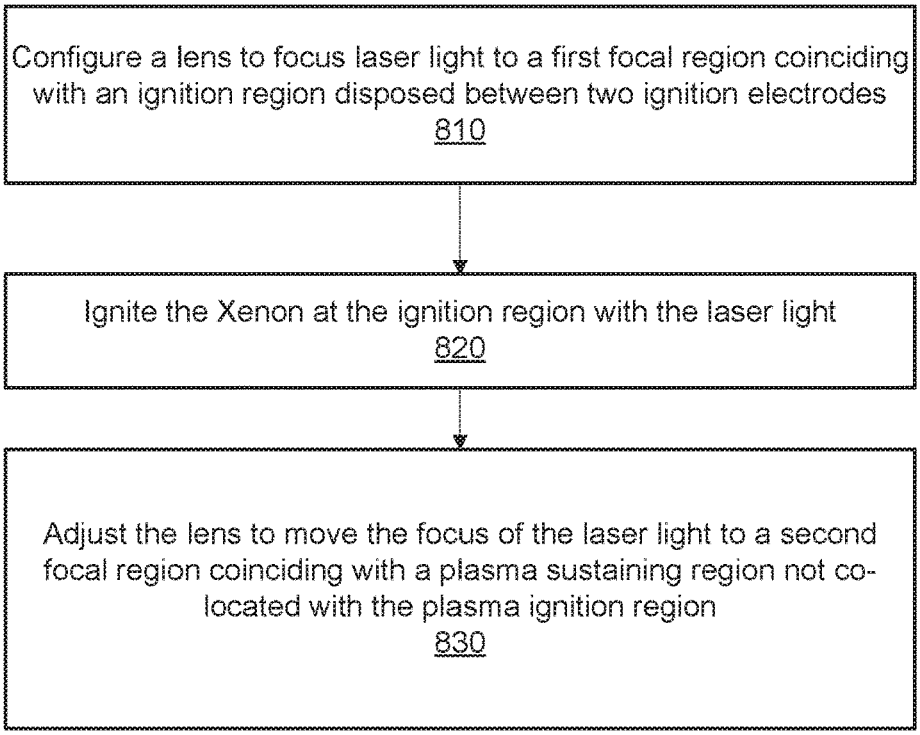
FIG. 8 is a flowchart of a first exemplary method for operating a sealed beam lamp.

FIG. 8 is a flowchart of a first exemplary method for operating a sealed beam lamp. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

An exemplary lamp that may be used with the method is depicted by FIGS. 4A and 4B. The lamp 400 includes a sealed chamber 320, a pair of ignition electrodes 490, 491, a substantially flat chamber ingress window 330, a laser light source 360 disposed outside the chamber, and a lens 370 disposed in the path of laser light 362 between the laser light source 360 and the ingress window 330. The lens 370 is configured to movably focus the laser beam to one or more focal regions within the chamber 320.

The method includes configuring the lens 370 to focus the laser light 362 to a first focal region 472 (FIG. 4A) coinciding with an ignition region 421 disposed between the ignition electrodes 490, 491, as shown by block 810. The gas, for example, Xenon gas, is ignited by the focused ingress laser light 365 at the ignition region 421, as shown by block 820. The lens 370 is adjusted to move the focus of the ingress laser light 365 to a second focal region 472 (FIG. 4B) coinciding with a plasma sustaining region 326 not co-located with the plasma ignition region 421.

Figure 9:
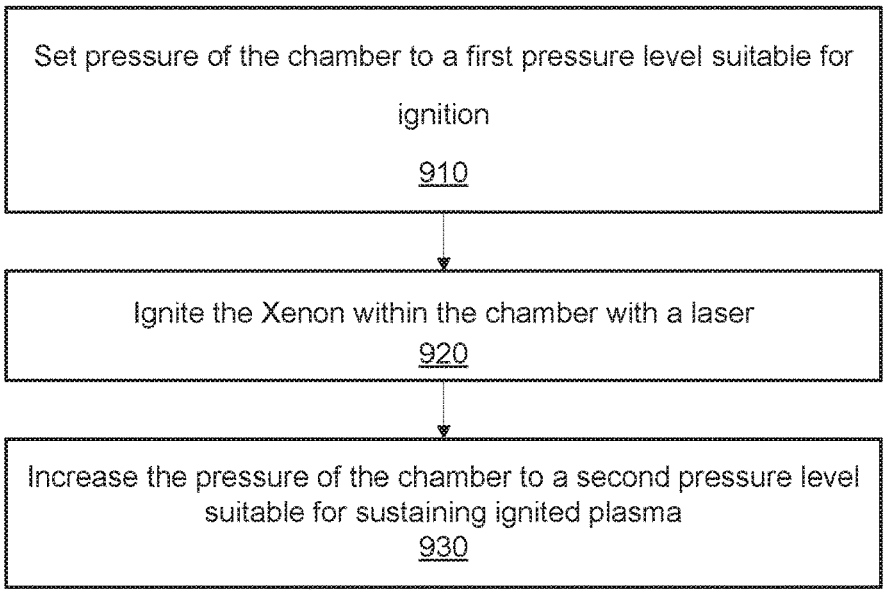
FIG. 9 is a flowchart of a second exemplary method for operating a sealed beam lamp without ignition electrodes.

FIG. 9 is a flowchart of a second exemplary method for operating a sealed beam lamp without ignition electrodes. An exemplary lamp that may be used with the method is depicted by FIG. 6. The lamp 600 includes a sealed chamber 320, a laser light source 360 disposed outside the chamber, and a lens 370 disposed in the path of laser light 362 between the laser light source 360 and an ingress window 330.

The lamp 600 has a sealed chamber 320, a laser light source 360 disposed outside the chamber 320, configured to focus the laser beam 362 to a focal region 472 within the chamber 320. The light may be focused by the lens 370, or may be focused directly by the laser light source 360 without use of a lens. The sealed lamp 600 includes a reservoir chamber 690 filled with pressurized Xenon gas having an evacuation/fill channel 692. The pressure of the chamber 320 is set to a first pressure level, as shown by block 910. The Xenon within the chamber 320 is ignited with light 365 from the laser 360, as shown by block 920. A pump system 696 connects the reservoir chamber 690 with the lamp chamber 320 via a gas ingress fill valve 694. Upon ignition the Xenon fill pressure in the lamp chamber 320 is held at a first level, for example, a sub atmosphere level. When the laser 360 ignites the Xenon forming a low pressure plasma, the pump system 696 increases the pressure within the lamp chamber 320. The pressure within the lamp 600 may be increased to a second pressure level, for example a level where the high intensity egress light 329 output from the plasma reaches a desirable intensity, as shown by block 930.

Figure 11:
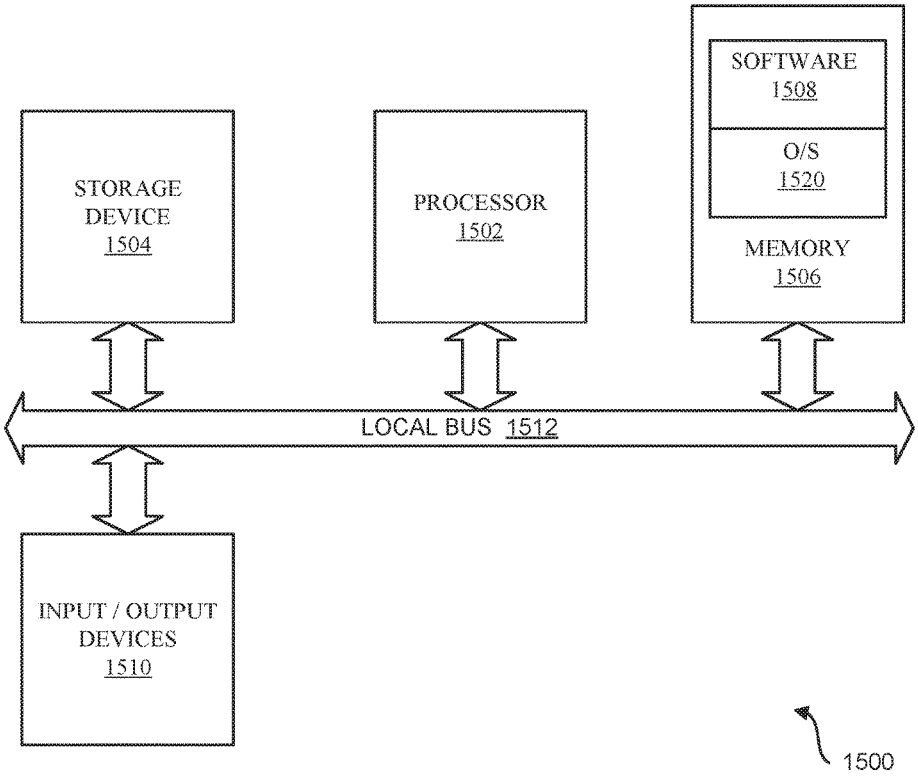
FIG. 11 is a schematic diagram illustrating an example of a system for executing functionality of the present invention.

As previously mentioned, the present system for executing the controller functionality described in detail above may be a computer, an example of which is shown in the schematic diagram of FIG. 11. The system 1500 contains a processor 1502, a storage device 1504, a memory 1506 having software 1508 stored therein that defines the above-mentioned functionality, input and output (I/O) devices 1510 (or peripherals), and a local bus, or local interface 1512 allowing for communication within the system 1500. The local interface 1512 can be, for example but not limited to, one or more buses or other wired or wireless connections, as is known in the art. The local interface 1512 may have additional elements, which are omitted for simplicity, such as controllers, buffers (caches), drivers, repeaters, and receivers, to enable communications. Further, the local interface 512 may include address, control, and/or data connections to enable appropriate communications among the aforementioned components.

The processor 1502 is a hardware device for executing software, particularly that stored in the memory 1506. The processor 1502 can be any custom made or commercially available single core or multi-core processor, a central processing unit (CPU), an auxiliary processor among several processors associated with the present system 1500, a semiconductor based microprocessor (in the form of a micro chip or chip set), a microprocessor, or generally any device for executing software instructions.

The memory 1506 can include any one or combination of volatile memory elements (e.g., random access memory (RAM, such as DRAM, SRAM, SDRAM, etc.)) and non-volatile memory elements (e.g., ROM, hard drive, tape, CDROM, etc.). Moreover, the memory 1506 may incorporate electronic, magnetic, optical, and/or other types of storage media. Note that the memory 1506 can have a distributed architecture, where various components are situated remotely from one another, but can be accessed by the processor 1502.

The software 508 defines functionality performed by the system 1500, in accordance with the present invention. The software 1508 in the memory 1506 may include one or more separate programs, each of which contains an ordered listing of executable instructions for implementing logical functions of the system 1500, as described below. The memory 1506 may contain an operating system (O/S) 1520. The operating system essentially controls the execution of programs within the system 500 and provides scheduling, input-output control, file and data management, memory management, and communication control and related services.

The I/O devices 1510 may include input devices, for example but not limited to, a keyboard, mouse, scanner, microphone, etc. Furthermore, the I/O devices 1510 may also include output devices, for example but not limited to, a printer, display, etc. Finally, the I/O devices 1510 may further include devices that communicate via both inputs and outputs, for instance but not limited to, a modulator/demodulator (modem; for accessing another device, system, or network), a radio frequency (RF) or other transitive, a telephonic interface, a bridge, a router, or other device.

When the system 1500 is in operation, the processor 1502 is configured to execute the software 1508 stored within the memory 1506, to communicate data to and from the memory 1506, and to generally control operations of the system 1500 pursuant to the software 1508, as explained above.

When the functionality of the system 1500 is in operation, the processor 1502 is configured to execute the software 1508 stored within the memory 1506, to communicate data to and from the memory 1506, and to generally control operations of the system 1500 pursuant to the software 1508. The operating system 1520 is read by the processor 1502, perhaps buffered within the processor 1502, and then executed.

When the system 1500 is implemented in software 1508, it should be noted that instructions for implementing the system 1500 can be stored on any computer-readable medium for use by or in connection with any computer-related device, system, or method. Such a computer-readable medium may, in some embodiments, correspond to either or both the memory 1506 or the storage device 1504. In the context of this document, a computer-readable medium is an electronic, magnetic, optical, or other physical device or means that can contain or store a computer program for use by or in connection with a computer-related device, system, or method. Instructions for implementing the system can be embodied in any computer-readable medium for use by or in connection with the processor or other such instruction execution system, apparatus, or device. Although the processor 1502 has been mentioned by way of example, such instruction execution system, apparatus, or device may, in some embodiments, be any computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the processor or other such instruction execution system, apparatus, or device.

Such a computer-readable medium can be, for example but not limited to, an electronic, magnetic, optical, electromagnetic, infrared, or semiconductor system, apparatus, device, or propagation medium. More specific examples (a non exhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

In an alternative embodiment, where the system 1500 is implemented in hardware, the system 1500 can be implemented with any or a combination of the following technologies, which are each well known in the art: a discrete logic circuit(s) having logic gates for implementing logic functions upon data signals, an application specific integrated circuit (SIC) having appropriate combinational logic gates, a programmable gate array(s) (PGA), a field programmable gate array (FPGAs), etc.

In summary it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A sealed high intensity illumination device configured to receive a laser beam from a laser light source comprising:

a sealed chamber configured to contain an ionizable medium, the chamber further comprising:

a reflective chamber interior surface further comprising:

a first substantially parabolic contour having a first parabolic focal region;

a second substantially parabolic contour having a second parabolic focal region; and an interface surface;

an ingress surface disposed within the interface surface configured to admit the laser beam into the chamber; and an egress surface disposed within the interface surface configured to emit high intensity light from the chamber, wherein the first parabolic contour is configured to reflect light from the first parabolic focal region to the second parabolic contour, and the second parabolic contour is configured to reflect light from the first parabolic contour to the second parabolic focal region.

2. The sealed high intensity illumination device of claim 1 wherein a first path of the laser beam from the laser light source through the ingress surface to the first parabolic focal region is direct, and a second path from the second parabolic focal region to the egress surface is direct.

3. The sealed high intensity illumination device of claim 1, wherein the sealed chamber body is selected from the group consisting of quartz, sapphire, oxygen free copper, aluminum, silver, and reflecting metal.

4. The sealed high intensity illumination device of claim 1, wherein the sealed chamber body comprises nickel-cobalt ferrous alloy.

5. The sealed high intensity illumination device of claim 4, wherein the sealed chamber body is copper free.

6. The sealed high intensity illumination device of claim 1, wherein the reflective interior surface is substantially transparent to a wavelength of the laser beam.

7. The sealed high intensity illumination device of claim 1, further comprising a plasma sustaining region and a plasma ignition region disposed within the sealed chamber.

8. The sealed high intensity illumination device of claim 7, wherein the plasma sustaining region and the plasma ignition region are co-located between a first electrode and a second electrode.

9. The sealed high intensity illumination device of claim 8, wherein the first electrode and the second electrode are substantially symmetrical in shape.

10. The sealed high intensity illumination device of claim 8, wherein the first electrode and the second electrode are separated by a gap of over 1 mm.

11. The sealed high intensity illumination device of claim 1, further comprising the laser light source disposed external to the sealed chamber and configured to direct a laser light beam directly into the sealed chamber.

12. The sealed high intensity illumination device of claim 1, wherein the ingress surface and the egress surface are disposed within a common surface of the sealed chamber.

13. The sealed high intensity illumination device of claim 12, wherein the ingress surface and the egress surface are oriented substantially parallel to one another.

14. The sealed high intensity illumination device of claim 1, wherein the first parabolic contour and the second parabolic contour are arranged to provide 1:1 imaging from the first parabolic focal region to the second parabolic focal region.

15. The sealed high intensity illumination device of claim 14, wherein the egress surface corresponds to an ingress surface of a light guide or fiber.

16. The sealed high intensity illumination device of claim 14, wherein the ingress surface corresponds to an egress surface of a light guide or fiber.

17. The sealed high intensity illumination device of claim 1, wherein the plasma sustaining region coincides with the first parabolic focal region and/or the second parabolic focal region.

18. The sealed high intensity illumination device of claim 1, wherein the ionizable medium is selected from the group consisting of Xenon gas, Argon gas, and Krypton gas.

19. The sealed high intensity illumination device of claim 3, wherein the oxygen free copper or aluminum comprises a reflector embedded in a Kovar® shell.

* * * * *